US012188739B2

(12) United States Patent
Natesan et al.

(10) Patent No.: US 12,188,739 B2
(45) Date of Patent: Jan. 7, 2025

(54) AUTOMATED PROJECTILE LOADER AND A METHOD OF LOADING PROJECTILES FOR A VEHICLE

(71) Applicant: Chairman, Defence Research And Development Organisation (DRDO), New Delhi (IN)

(72) Inventors: Babu Natesan, Tamil Nadu (IN); Roshan Samuel Raja Rajesh Kumar, Tamil Nadu (IN); Balaguru Vadivel, Tamil Nadu (IN); Rajakumar Rai S, Tamil Nadu (IN); Dhanpal Murugesan, Tamil Nadu (IN)

(73) Assignee: CHAIRMAN, DEFENCE RESEARCH AND DEVELOPMENT ORGANISATION (DRDO), New Delhi (IN)

( * ) Notice: Subject to any disclaimer, the term of this patent is extended or adjusted under 35 U.S.C. 154(b) by 0 days.

(21) Appl. No.: 18/260,837

(22) PCT Filed: Jan. 7, 2022

(86) PCT No.: PCT/IN2022/050016
§ 371 (c)(1),
(2) Date: Jul. 10, 2023

(87) PCT Pub. No.: WO2022/162684
PCT Pub. Date: Aug. 4, 2022

(65) Prior Publication Data

US 2024/0077265 A1 Mar. 7, 2024

(30) Foreign Application Priority Data

Jan. 28, 2021 (IN) ..... 202111003860

(51) Int. Cl.
*F41A 9/37* (2006.01)
*F41A 9/16* (2006.01)
*F41A 9/42* (2006.01)

(52) U.S. Cl.
CPC ..... *F41A 9/37* (2013.01); *F41A 9/16* (2013.01); *F41A 9/42* (2013.01)

(58) Field of Classification Search
CPC ..... F41A 9/04; F41A 9/16; F41A 9/37; F41A 9/42
See application file for complete search history.

(56) References Cited

U.S. PATENT DOCUMENTS 4,700,609 A * 10/1987 Wiethoff ..... F41A 9/76 89/46
5,837,922 A * 11/1998 Maher ..... F41A 9/06 89/46

(Continued)

FOREIGN PATENT DOCUMENTS

| | | |
|---|---|---|
| EP | 0105101 A2 | 4/1984 |
| ES | 2304533 T3 | 10/2008 |
| JP | H0626789 A | 2/1994 |

OTHER PUBLICATIONS

International Search Report for International Application No. PCT/IN2022/050016; International Filing Date—Jan. 7, 2022; Date of Mailing—Apr. 21, 2022; 3 pages.

(Continued)

*Primary Examiner* — Bret Hayes
(74) *Attorney, Agent, or Firm* — CANTOR COLBURN LLP

(57) ABSTRACT

An automated projectile loader and a method of loading projectile for a vehicle is disclosed. The automated projectile loader includes a carousal projectile unit mounted on a hull of the vehicle. The carousal projectile unit includes a carousal storage adapted to store a plurality of projectiles (Continued)

oriented in a vertical direction. The automated projectile loader includes a bustle projectile unit disposed at a rear end of a turret of the vehicle. The bustle projectile unit includes a bustle storage adapted to store a plurality of projectiles and propellants oriented in a horizontal direction. The automated projectile loader includes an automated arm disposed below the turret and adapted to load the plurality of projectiles from one of the carousal storage and the bustle storage in a barrel orientated in any angle in the turret.

16 Claims, 22 Drawing Sheets

(56) References Cited

U.S. PATENT DOCUMENTS 6,769,344 B2 * 8/2004 Domeij ..... F41A 9/16
89/47
7,159,504 B2 * 1/2007 Heldmann ..... F41A 9/64
89/46

OTHER PUBLICATIONS

Written Opinion of the International Searching Authority for International Application No. PCT/IN2022/050016; International Filing Date—Jan. 7, 2022; Date of Mailing—Apr. 21, 2022; 4 pages.

* cited by examiner

AUTOMATED PROJECTILE LOADER AND A METHOD OF LOADING PROJECTILES FOR A VEHICLE

CROSS REFERENCE TO RELATED APPLICATIONS

This application is a National Stage application of PCT/IN2022/050016, filed Jan. 7, 2022, which claims priority to India application No. 202111003860, filed Jan. 28, 2021, and all the benefits accruing therefrom under 35 U.S.C. § 119, the content of which is incorporated by reference in its entirety.

FIELD OF THE INVENTION

The present invention relates to projectile loader for vehicles and in particular, relates to, an automated projectile loader for loading projectiles from a carousal storage and a bustle storage of a vehicle.

BACKGROUND

Worldwide, armored vehicle manufacturers are focusing to remove operator who involved for manual loading of projectiles into a turret. Owing to involvement of the operator in the loading system, it is essential to provide high head room for the operator to handle projectiles effectively. Also, the armor protection demands heavily for the turret which is unavoidable and this will lead into high weight penalty in the design of an armored vehicle. Ultimately, removing the operator from the turret will improve the overall configuration of vehicle in terms of size, shape and weight. The primary motivation for autoloader is to increase the loading rate of projectile which is essential in the modern armored vehicle.

In general, there are two kinds of autoloaders such as carousal and bustle mounted are implemented and in operation. In this case once the projectile either in carousal or bustle is utilized then loading of storage system is done by manually. With this arrangement, the numbers of rounds are limited for firing. Further, auto loading arrangement from both the storage was not attempted because of space constraint and too many systems are required to automate the bustle and carousal system. Most of the autoloader are handling single piece projectile, which simply the loading mechanism but in the case two piece wherein projectile and cartridge are separated to meet the long armour penetration capability. This becomes challenge to accommodate in the available space and also difficult to load two pieces independently. Most of the autoloader are configured to operate to load projectiles in fixed turret angle at zero-degree elevation.

In light of the above, there is a need to develop compact autoloader system to load the projectiles from the carousal as well as from bustle. Also, there is a need to develop an autoloader configured to load projectiles at any turret elevation angle from carousal and bustle storage.

SUMMARY

This summary is provided to introduce a selection of concepts, in a simplified format, that are further described in the detailed description of the invention. This summary is neither intended to identify key or essential inventive concepts of the invention and nor is it intended for determining the scope of the invention.

In an embodiment of the present disclosure, an automated projectile loader for a vehicle is disclosed. The automated projectile loader includes a carousal projectile unit mounted on a hull of the vehicle. The carousal projectile unit includes a carousal storage adapted to store a plurality of projectiles oriented in a vertical direction. Further, the automated projectile loader includes a bustle projectile unit disposed at a rear end of a turret of the vehicle. The bustle projectile unit includes a bustle storage adapted to store a plurality of projectiles and propellants oriented in a horizontal direction. Furthermore, the automated projectile loader includes an automated arm disposed below the turret and adapted to load the plurality of projectiles from one of the carousal storage and the bustle storage in a barrel of the turret. The automated arm is adapted to clasp a projectile from one of the carousal storage and the bustle storage and adapted align the projectile with the barrel. The automated projectile loader includes a controlling unit in communication with the automated arm. The controlling unit is configured to receive an input indicative of selection of a projectile from one of the carousal storage and the bustle storage. Further, the controlling unit is configured to operate the automated arm to load the projectile from one of the carousal storage and the bustle storage in the barrel based on the received input.

In another embodiment of the present disclosure, a method of loading projectiles in a turret of a vehicle is disclosed. The method includes receiving an input indicative of selection of a projectile from one of a bustle storage and a carousal storage to be loaded in a barrel of the turret. Further, the method includes operating an automated arm and one of a bustle projectile unit and a carousal projectile unit based on the received input. If the received input is indicative of selection of the projectile from the bustle storage, then the method includes driving a plurality of sprocket drives of the bustle projectile unit to align a bustle bin with the barrel of the turret. Further, the method includes actuating the bin rammer of the bustle projectile unit to push the bustle bin towards the barrel of the turret. The method includes operating the automated arm to hold the bustle bin and align the bustle bin with the central axis of the barrel. A solenoid pin mounted at a bin gripper of the automated arm is actuated to lock the bustle bin with the bin gripper. Further, the method includes actuating a rammer positioned at the rear end of the barrel to load the projectile and propellant from the bustle bin in the barrel of the turret. The method includes actuating a bin rammer to pull the bustle bin towards the bustle storage of the bustle projectile unit. If the received input is indicative of selection of the projectile from the carousal storage, then the method includes moving a carousal base of the carousal projectile unit to align a carousal twin bin to be aligned with the barrel of the turret. Further, the method includes operating the automated arm to hold the carousal twin bin and align the carousal twin bin with the central axis of the barrel. The solenoid pin mounted at the bin gripper is actuated to lock the carousal twin bin with the bin gripper. Further, the method includes actuating the rammer to load the projectile and propellant from the carousal twin bin in the barrel. The rammer is adapted to slide the projectile from the first bin of the carousal twin bin and subsequently slide the propellant from the second bin of the carousal twin bin.

To further clarify advantages and features of the present invention, a more particular description of the invention will be rendered by reference to specific embodiments thereof, which is illustrated in the appended drawings. It is appreciated that these drawings depict only typical embodiments of the invention and are therefore not to be considered limiting of its scope. The invention will be described and explained with additional specificity and detail with the accompanying drawings.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

Figure 1:
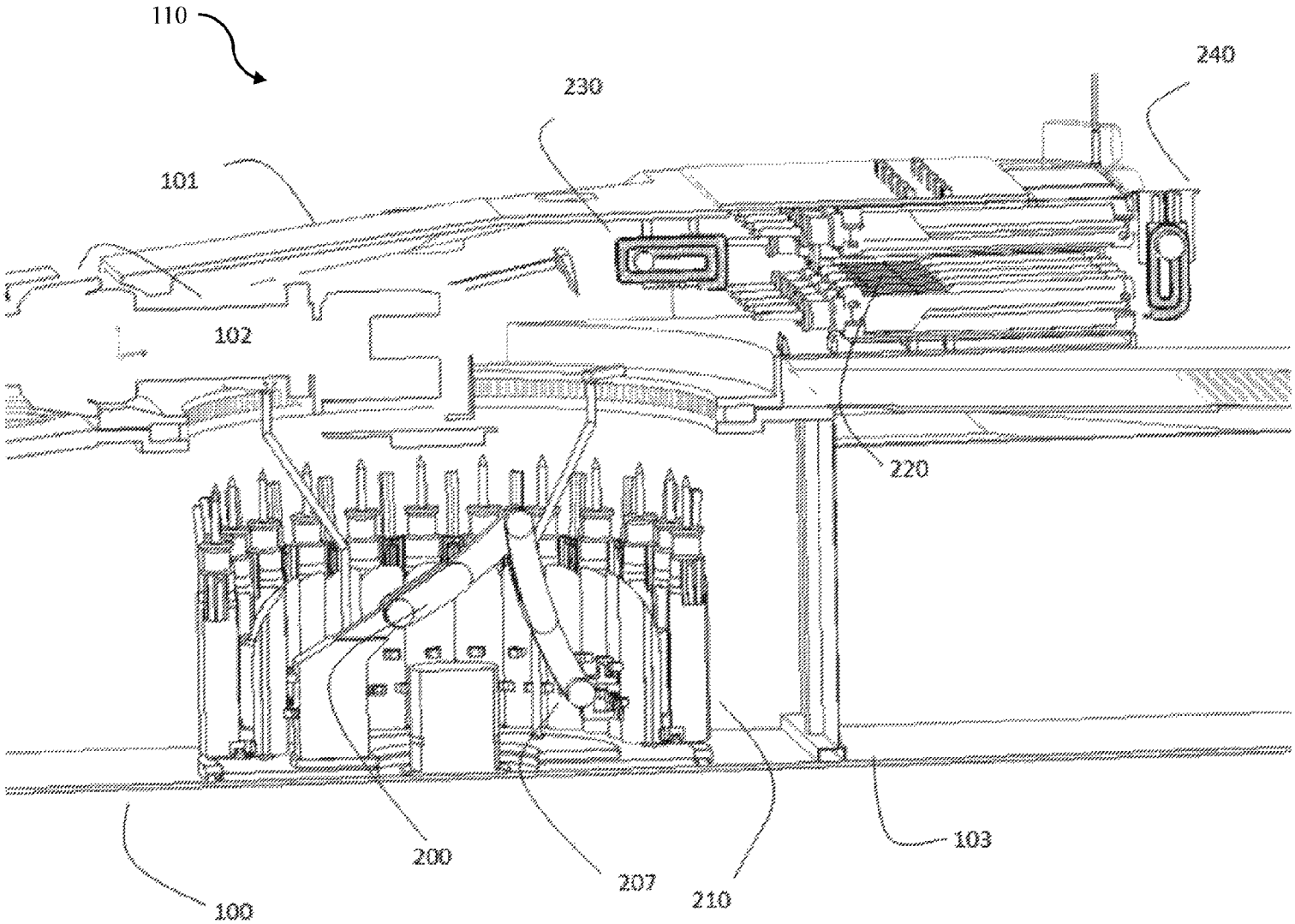
FIG. 1 illustrates a perspective view of an automated projectile loader for a vehicle, according to an embodiment of the present disclosure.

Further, skilled artisans will appreciate that elements in the drawings are illustrated for simplicity and may not have been necessarily been drawn to scale. For example, the flow charts illustrate the method in terms of the most prominent steps involved to help to improve understanding of aspects of the present invention. Furthermore, in terms of the construction of the device, one or more components of the device may have been represented in the drawings by conventional symbols, and the drawings may show only those specific details that are pertinent to understanding the embodiments of the present invention so as not to obscure the drawings with details that will be readily apparent to those of ordinary skill in the art having benefit of the description herein.

DETAILED DESCRIPTION OF FIGURES

For the purpose of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated system, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The system, methods, and examples provided herein are illustrative only and not intended to be limiting.

The term "some" as used herein is defined as "none, or one, or more than one, or all." Accordingly, the terms "none," "one," "more than one," "more than one, but not all" or "all" would all fall under the definition of "some." The term "some embodiments" may refer to no embodiments or to one embodiment or to several embodiments or to all embodiments. Accordingly, the term "some embodiments" is defined as meaning "no embodiment, or one embodiment, or more than one embodiment, or all embodiments."

The terminology and structure employed herein is for describing, teaching and illuminating some embodiments and their specific features and elements and does not limit, restrict or reduce the spirit and scope of the claims or their equivalents.

More specifically, any terms used herein such as but not limited to "includes," "comprises," "has," "consists," and grammatical variants thereof do NOT specify an exact limitation or restriction and certainly do NOT exclude the possible addition of one or more features or elements, unless otherwise stated, and furthermore must NOT be taken to exclude the possible removal of one or more of the listed features and elements, unless otherwise stated with the limiting language "MUST comprise" or "NEEDS TO include."

Whether or not a certain feature or element was limited to being used only once, either way it may still be referred to as "one or more features" or "one or more elements" or "at least one feature" or "at least one element." Furthermore, the use of the terms "one or more" or "at least one" feature or element do NOT preclude there being none of that feature or element, unless otherwise specified by limiting language such as "there NEEDS to be one or more . . . " or "one or more element is REQUIRED."

Unless otherwise defined, all terms, and especially any technical and/or scientific terms, used herein may be taken to have the same meaning as commonly understood by one having an ordinary skill in the art.

Reference is made herein to some "embodiments." It should be understood that an embodiment is an example of a possible implementation of any features and/or elements presented in the attached claims. Some embodiments have been described for the purpose of illuminating one or more of the potential ways in which the specific features and/or elements of the attached claims fulfil the requirements of uniqueness, utility and non-obviousness.

Use of the phrases and/or terms such as but not limited to "a first embodiment," "a further embodiment," "an alternate embodiment," "one embodiment," "an embodiment," "multiple embodiments," "some embodiments," "other embodiments," "further embodiment", "furthermore embodiment", "additional embodiment" or variants thereof do NOT necessarily refer to the same embodiments. Unless otherwise specified, one or more particular features and/or elements described in connection with one or more embodiments may be found in one embodiment, or may be found in more than one embodiment, or may be found in all embodiments, or may be found in no embodiments. Although one or more features and/or elements may be described herein in the context of only a single embodiment, or alternatively in the context of more than one embodiment, or further alternatively in the context of all embodiments, the features and/or elements may instead be provided separately or in any appropriate combination or not at all. Conversely, any features and/or elements described in the context of separate embodiments may alternatively be realized as existing together in the context of a single embodiment.

Any particular and all details set forth herein are used in the context of some embodiments and therefore should NOT be necessarily taken as limiting factors to the attached claims. The attached claims and their legal equivalents can be realized in the context of embodiments other than the ones used as illustrative examples in the description below.

Embodiments of the present invention will be described below in detail with reference to the accompanying drawings.

In one of the embodiments of the present disclosure, an autoloader for loading two pieces projectile from carousal and bustle storage is disclosed. The autoloader comprises a loading robotics arm configured to handle projectile from carousal and bustle, wherein the carousal autoloader device comprises: one robotic arm platform configured to be mounted at the bottom of the turret in the vehicle. The carousal storage systems with projectile holder are arranged in the form circular on the base plate which is fitted on hull. The whole base plates with projectile in carousal storage are rotated in both direction with necessary electric motor and gear train mounted on the hull. Further, there is alternate powering of the base plate is achieved using manual override. The robotics links are configured to mount with chain drive directly with human handle for the respective link rotation. There is rammer mounted on the roof plate of turret to slide the projectile into a turret. Since, it is two-piece projectile; the ramming cycle is operated in two times to load projectile and then proposition with prescribed time of interval. The complete cycle of operation such as holding of projectile mounted casing from the carousal frame, lifting the casing bin to an axis of the turret, ramming of projectile, further aligning of propulsion with the axis of the turret using robotic arm, ramming of propulsion and returning the projectile casing to home location in base plate.

Referring now to the drawings wherein the drawings are for the purpose of illustrating an exemplary embodiment of the disclosure only, and not for the purpose of limiting the same.

FIG. 1 illustrates a perspective view of an automated projectile loader 110 for a vehicle 100, according to an embodiment of the present disclosure. In an embodiment, the automated projectile loader 110 may be employed in the vehicle 100 for loading projectiles from different storage locations, such as bustle and carousal. The vehicle may be embodied as an armored vehicle, without departing from the scope of the present disclosure. In an embodiment, the vehicle 100 may include, but is not limited to, a turret 101, a hull 103, a controlling unit 104, an automated arm 200, a carousal projectile unit 210, and a bustle projectile unit 220.

In an embodiment, the hull 103 may be adapted to accommodate crews to reduce the protection level at the turret 101 which leads to weight penalty. The automated arm 200 may be disposed below the turret 101. Further, the carousal projectile unit 210 may be mounted on the hull 103 of the vehicle 100. The bustle projectile unit 220 may be disposed at a rear end of the turret 101 of the vehicle 100. Constructional and operation details of the automated arm 200, the carousal projectile unit 210, and the bustle projectile unit 220 are explained in the subsequent sections of the present disclosure.

Figure 2A:
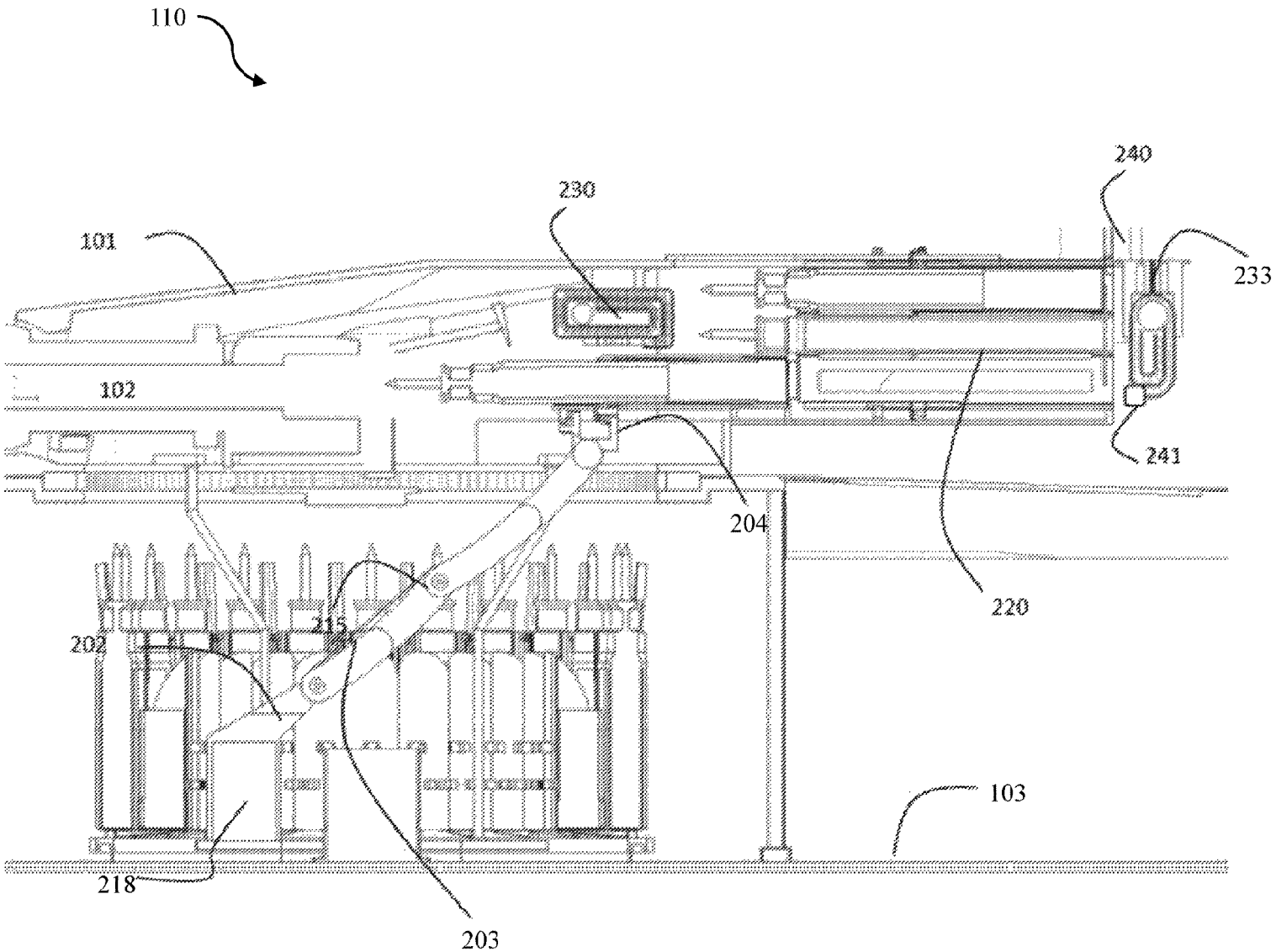
FIGS. 2*a*-2*c* illustrate the automated projectile loader depicting loading of a projectile from the bustle projectile unit, according to an embodiment of the present disclosure.
Figure 2B:
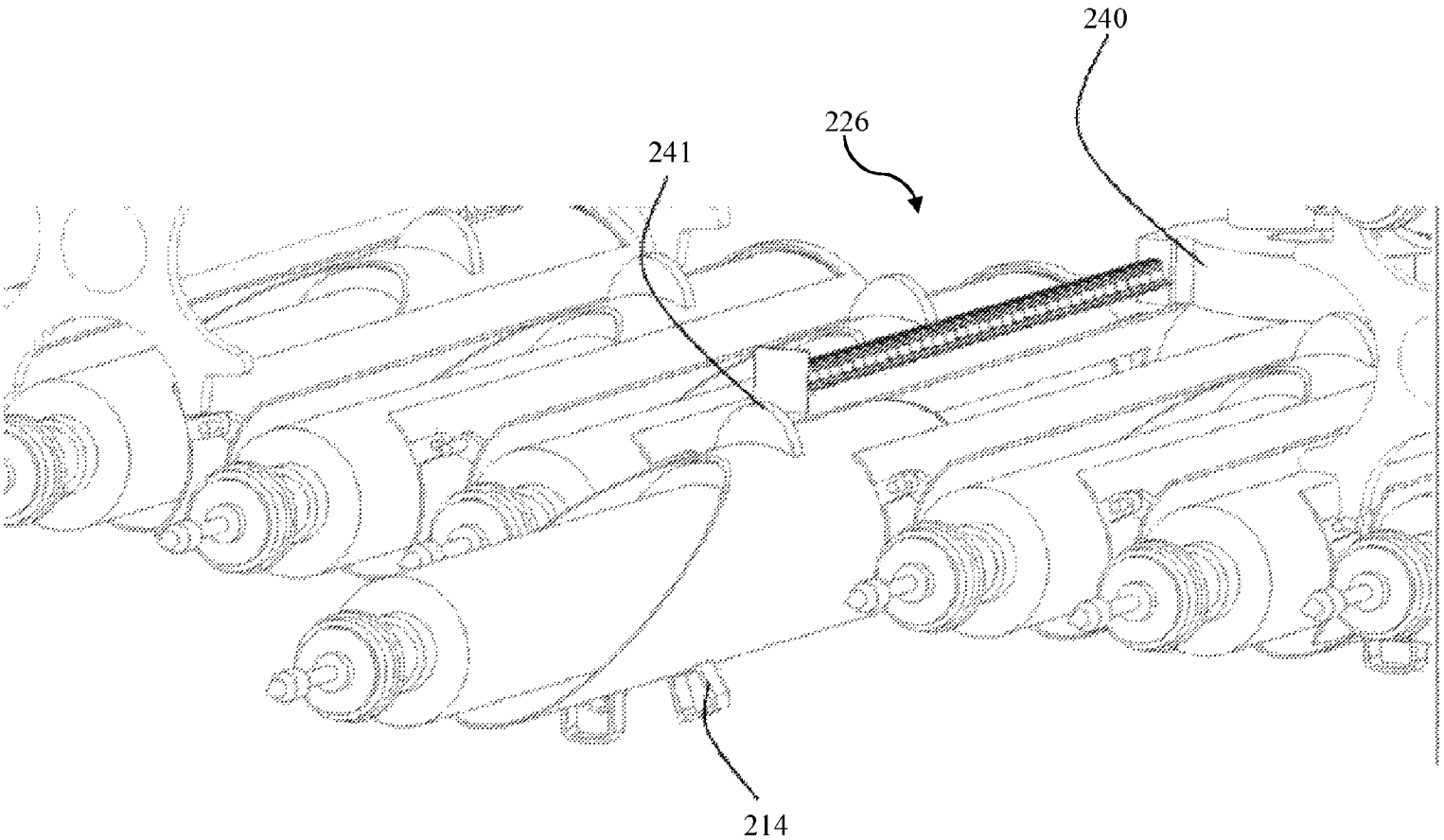
Figure 2C:
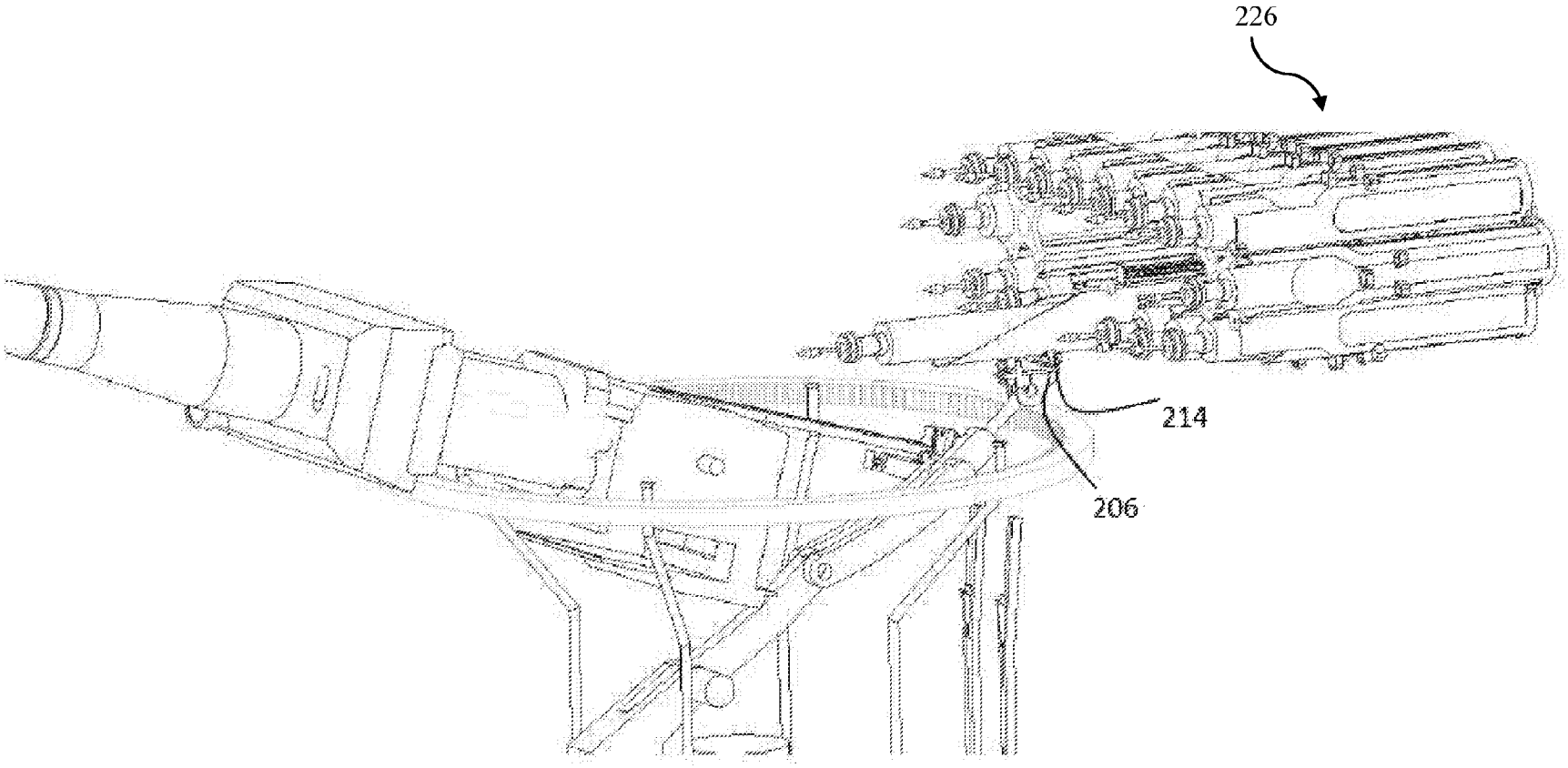

FIGS. 2*a*-2*c* illustrate the automated projectile loader 110 depicting loading of a projectile from the bustle projectile unit 220, according to an embodiment of the present disclosure. In an embodiment, the bustle projectile unit 220 may include a bustle storage 226 adapted to store a plurality of projectiles and propellants oriented in a horizontal direction. As mentioned earlier, the bustle projectile unit 220 may be disposed at the rear end of the turret 101 of the vehicle 100. In an embodiment, the bustle projectile unit may include, but is not limited to, a plurality of bustle bins 223, a plurality of sprocket drives 224, and a bin rammer 240. In an embodiment, the plurality of bustle bins 223 may be connected to another container with chain arrangement so that all the bin containers are linked as chain of containers.

Figure 3:
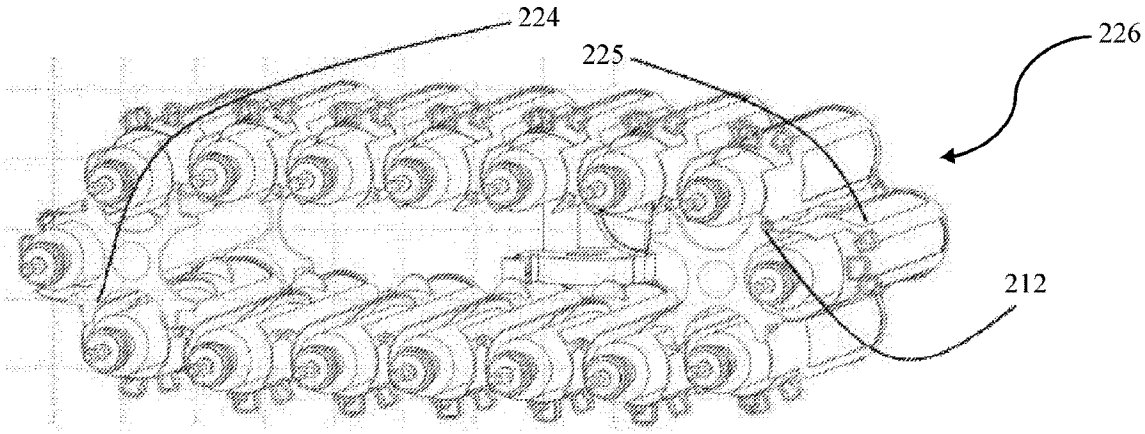
FIG. 3 illustrates a perspective view of the bustle storage of the bustle projectile unit, according to an embodiment of the present disclosure.
Figure 4A:
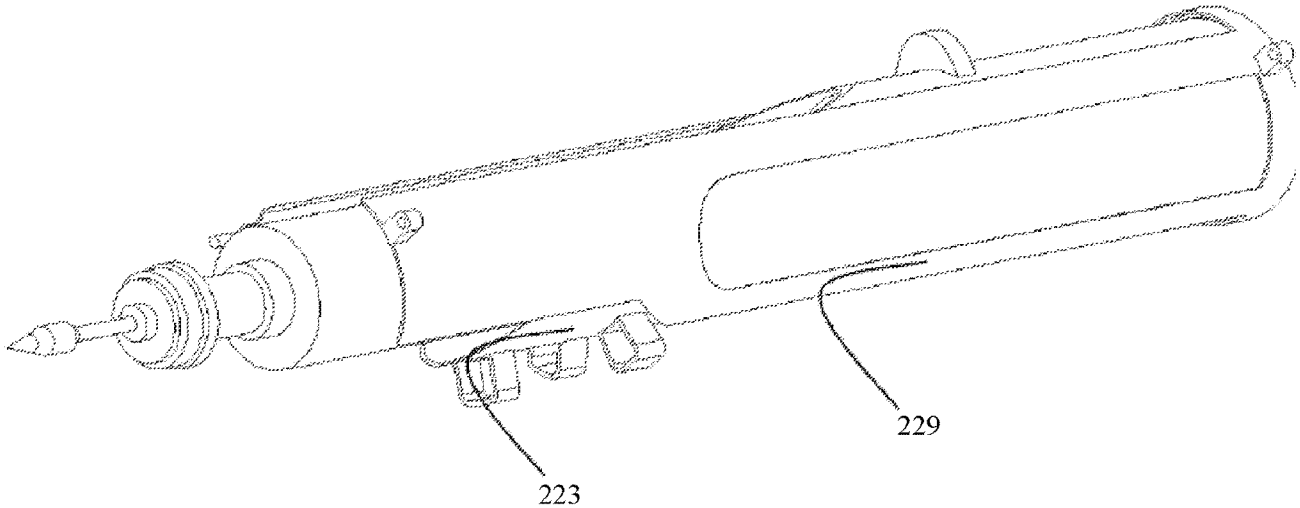
FIGS. 4*a* and 4*b* illustrates a perspective view and an exploded view, respectively, of a projectile from the bustle storage, according to an embodiment of the present disclosure.
Figure 4B:
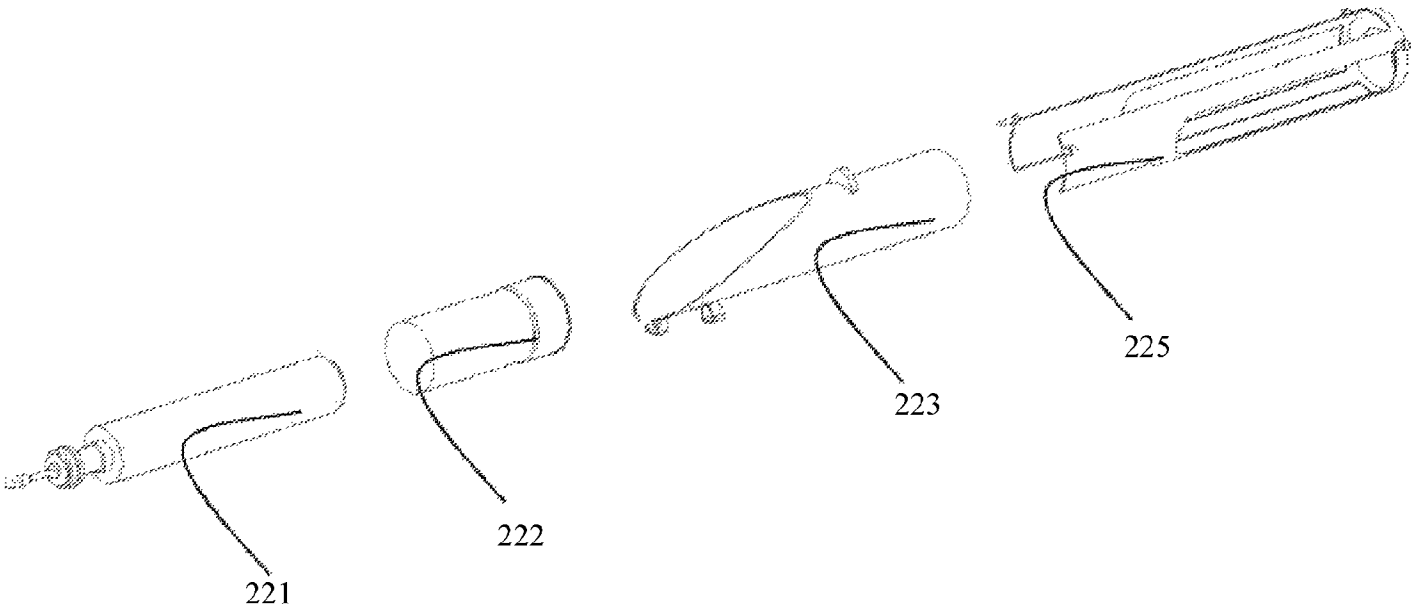

FIG. 3 illustrates a perspective view of the bustle storage 226 of the bustle projectile unit 220, according to an embodiment of the present disclosure. FIGS. 4*a* and 4*b* illustrates a perspective view and an exploded view, respectively, of a projectile from the bustle storage 226, according to an embodiment of the present disclosure. The bustle storage 226 may be adapted to store the plurality of bustle bins 223 to be loaded in a barrel 102 of the turret 101. The plurality of bustle bins 223 may be adapted to accommodate the plurality of projectiles and propellants. The plurality of bustle bins 223 may be adapted to be connected to each other to form a chain of bustle bins.

Referring to FIG. 2*a*, FIGS. 4*a*, and 4*b*, in an embodiment, each of the plurality of projectiles 221 and propellants 222 may be coaxially positioned in the each of the plurality of bustle bins 223. Further, each of the plurality of bustle bins 223 may be positioned in a container 225 adapted to hold the bustle bin. Each of the plurality of bustle bins 223 may include a protrusion adapted to be engaged with the bin rammer 240 to push the bin holder along with the projectile and propulsion from the container towards the barrel 102 of the turret 101. Further, each of the plurality of bustle bins 223 may include a plurality holding members 214 adapted to be engaged with the automated arm 200 to hold the bustle bin 223 while loading the projectile and propellent in the barrel 102 of the turret 101.

The plurality of bustle bins 223 may be designed in such a way to engage with sprocket teeth to get the drive motion. In an embodiment, referring to FIG. 3, each of the plurality of sprocket drives 224 may include at least four teeth adapted to be engaged with at least four containers holding the bustle bins 223. The plurality of sprocket drives 224 may be adapted to be engaged with the plurality of bustle bins 223. The plurality of sprocket drives 224 may be adapted to drive the chain of bustle bins 223. Each of the plurality of sprocket drives 224 may be adapted to be driven by an electric motor for indexing the projectiles in the bustle storage 226. The bin rammer 240 may be mounted on a rear side of the bustle storage 226 and adapted to move a bustle bin from among the plurality of bustle bins 223 in a direction towards or away with respect to the barrel 102 of the turret 101.

In an embodiment, the bin rammer 240 may be adapted to pull and push the bustle bin 223 towards the barrel 102. The bin rammer 240 may include, but is not limited to, a lead screw 233 and an engagement pin 241. The lead screw may be adapted to adjust a height of the bin rammer 240 with respect to the plurality of bustle bins 223 disposed in the bustle storage 226. Further, the engagement pin 241 may be adapted to be engaged with the protrusion formed on each of the plurality of bustle bins 223 to move the plurality of bustle 223 bins with respect to the barrel 102 of the turret 101. In an embodiment, a height of the bin rammer 240 may also be adjusted by using the lead screw drive for engage of rammer while driving back.

Figure 5A:
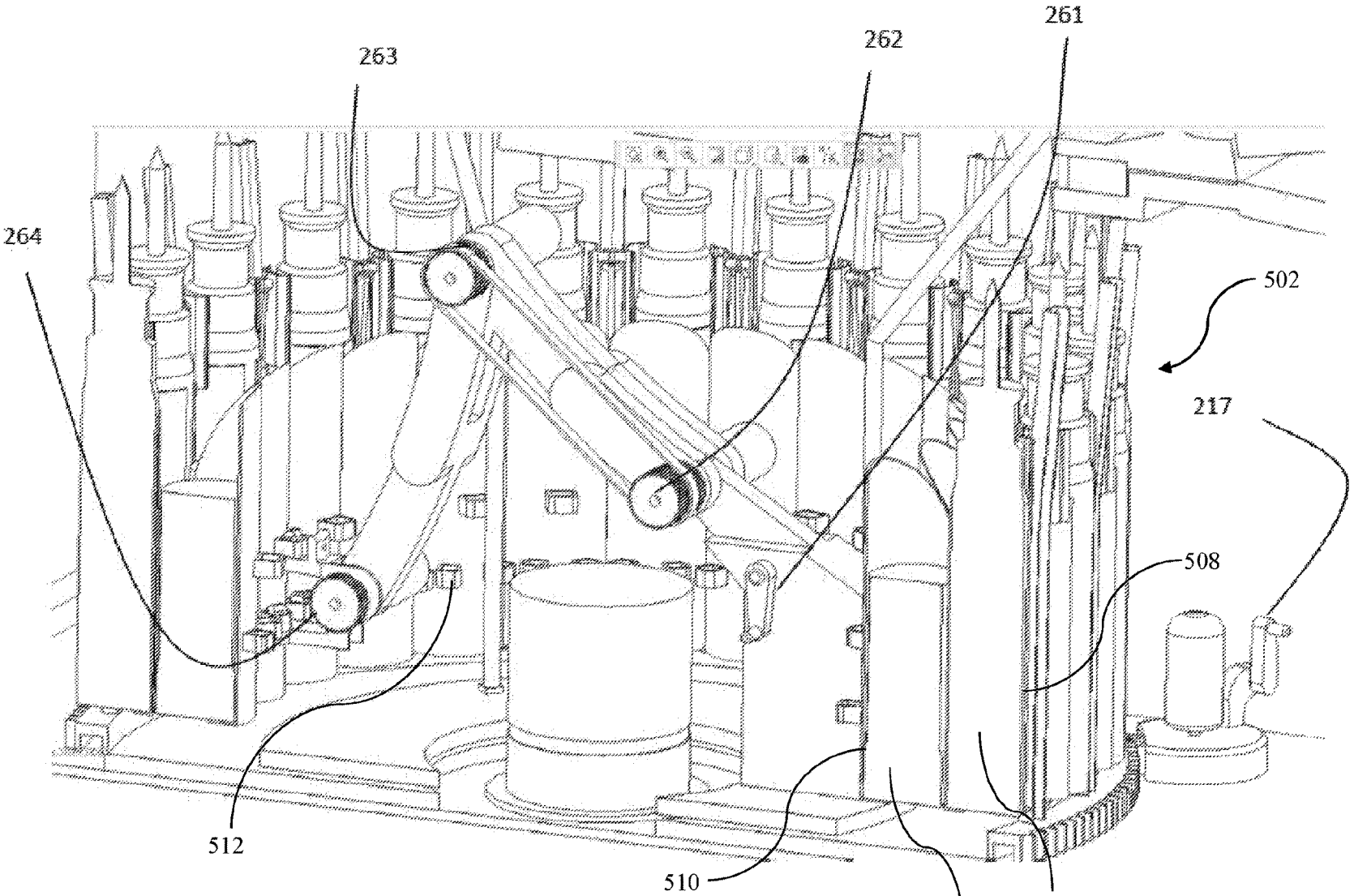
FIG. 5*a* illustrates a perspective view of the carousal projectile unit of the automated projectile loader, according to an embodiment of the present disclosure.

FIG. 5*a* illustrates a perspective view of the carousal projectile unit 210 of the automated projectile loader 110, according to an embodiment of the present disclosure. In an embodiment, the carousal projectile unit 210 may be mounted on the hull of the vehicle. The carousal projectile unit 210 may include a carousal storage 502 adapted to store a plurality of projectiles oriented in a vertical direction. In an embodiment, the carousal projectile unit 210 may include, but is not limited to, a carousal base 218, a plurality of carousal twin bins 211, a bin holder, a base motor 216, and a handle 217.

In an embodiment, the carousal base 218 may be rotatably disposed on the hull of the vehicle. The carousal base 218 may be adapted to be mounted with the carousal storage 502. In an embodiment, the carousal base 218 may be mounted on the hull with a bearing arrangement. The carousal base 218 may be rotated using the base motor 216 with a gear train arrangement. Further, the plurality of carousal twin bins 211 may be adapted to accommodate the plurality of projectiles 504 and propellants 506. Each of the plurality of carousal twin bins 211 may include a first bin 508 and a second bin 510. The first bin 508 may be adapted to accommodate a projectile from among the plurality of projectiles 504. The second bin 510 may be disposed adjacent to the first bin 508 adapted to accommodate a propellant 506.

The bin holder may be disposed on the carousal base 218 and adapted to hold the plurality of carousal twin bins 211. The bin holder may be formed collectively formed by the first bin 508 and the second bin 510 of the carousal twin bin 211. In an embodiment, the bin holder may include a plurality of holding members 512 adapted to be engaged with the automated arm 200 to hold the bin holder while loading the projectile and propellant in the barrel 102 of the turret 101. The base motor 216 may be coupled to the carousal base 218 and adapted to rotate the carousal base 218. The base motor 216 may rotate the carousal base 218 to a rotation angle based on a position of the turret 101 with respect to a central axis of the carousal base 218 and a number of carousal twin bins 211 disposed on the carousal base 218. The handle 217 may be engaged with the carousal base 218 and adapted to be manually operated to rotate the carousal base 218.

Figure 5B:
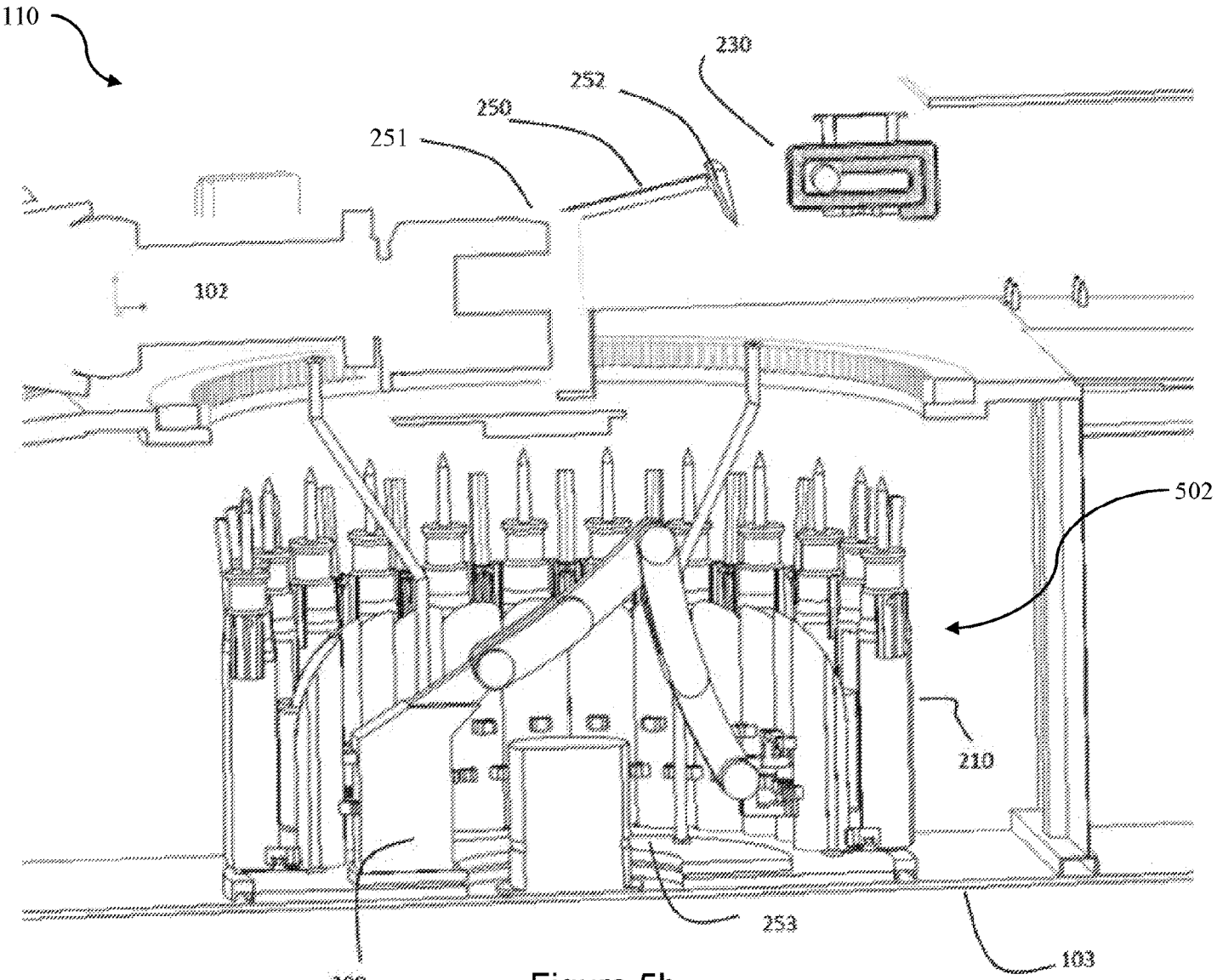
FIG. 5*b* illustrates a perspective view of the automated projectile loader depicting the carousal projectile unit, the rammer, and an ejector assembly, according to an embodiment of the present disclosure.
Figure 6:
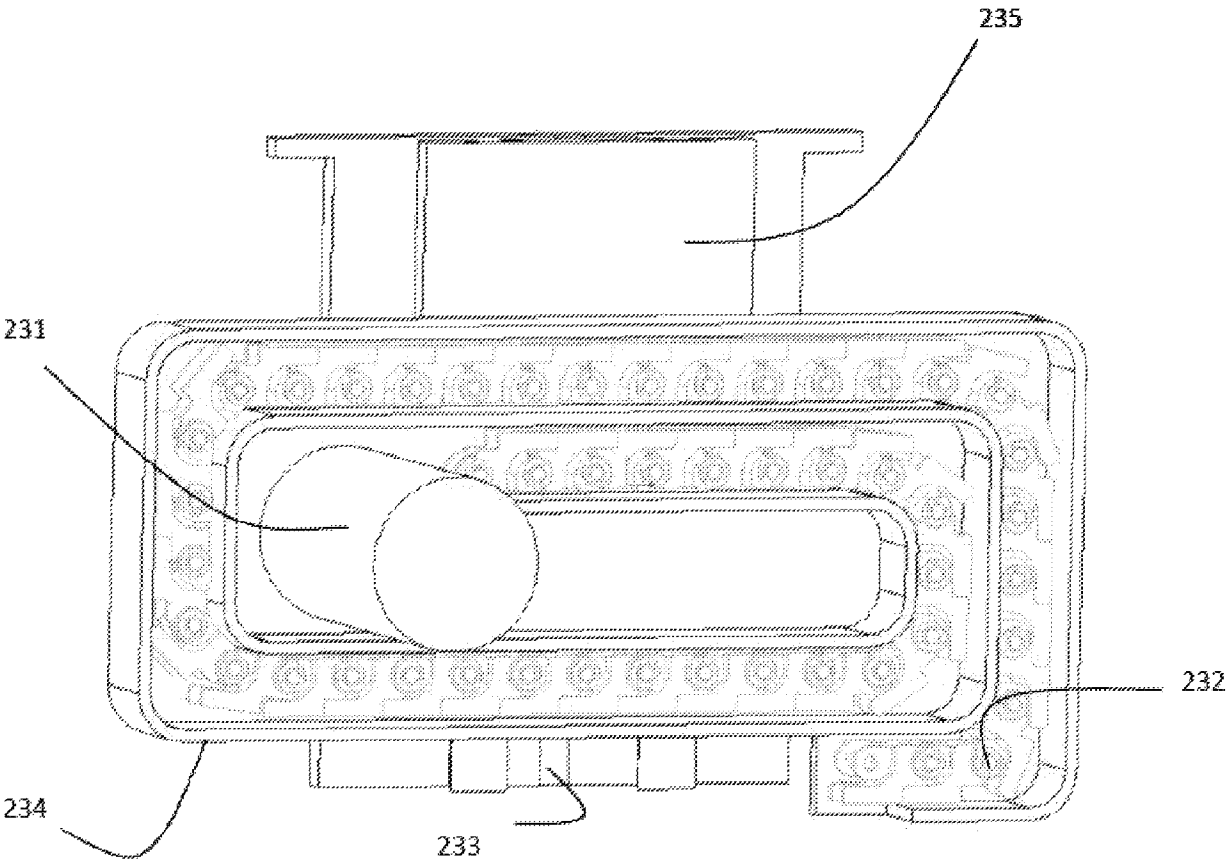
FIG. 6 illustrates a perspective view of the rammer of the automated projectile loader, according to an embodiment of the present disclosure.

FIG. 5*b* illustrates a perspective view of the automated projectile loader 110 depicting the carousal projectile unit 210, the rammer 230, and an ejector assembly 250, according to an embodiment of the present disclosure. FIG. 6 illustrates a perspective view of the rammer 230 of the automated projectile loader 110, according to an embodiment of the present disclosure. Referring to FIG. 5*b* and FIG. 6, in an embodiment, the rammer 230 may be disposed at a rear end of the barrel 102 of the turret 101. The rammer 230 may be adapted to slide the projectile along with the propellant within the barrel 102 from one of the bustle bin 223 and the carousal twin bin 211, when the automated arm 200 aligns one of the bustle bin 223 and the carousal twin bin 211 with a central axis of the barrel 102. In an embodiment, the rammer 230 may be adapted to slide the projectile and the propellant from the bustle bin 223 at a same time.

Referring to FIG. 6, in an embodiment, the rammer 230 may include, but is not limited to, an electric motor 231, a rammer chain 232, a chain housing 234, a lead screw 233, and a rammer support 235. The electric motor 231 may be adapted to swing the rammer 230 to slide the projectile along with the propellant within the barrel 102 from one of the bustle bin 223 and the carousal twin bin 211. The chain housing 234 may be adapted to accommodate the rammer chain 232. Further, the lead screw 233 may be adapted to adjust a height of the rammer 230 with respect to the barrel 102 of the turret 101. The rammer support 235 may be adapted to movably support at least the electric motor 231 and the chain housing 234.

Further, the rammer 230 may be adapted to slide the projectile from the first bin of the carousal twin bin 211 and subsequently, slide the propellant from the second bin of the carousal twin bin 211. The rammer chain 232 is combination of special links configured in such a way that the links are stiffened while moving in forward direction like linear rigid rod capable to push heavy object and rolled back compactly within the housing 234 during reverse direction of rotation. In particular, for the carousal twin bin 211, the rammer 230 has to be operated in two stage, first to slide projectile and second, the propulsion into the barrel 102 of the turret 101. For the bustle bin 223, the projectile and propulsion are kept in inline and in the same bin, i.e., the bin holder 223 and hence, the rammer 230 needs to slide both the projectile and propulsion at same time.

In an embodiment, the ejector assembly 250 may include, but is not limited to, a swing motor 251, a stub stopper 252, and a stub collector 253. The stub stopper 252 may be mounted on a rear end of the barrel 102 of the turret 101 and rotatably coupled to the swing motor 251. In an embodiment, the stub stopper 252 may be adapted to rotate with respect to an axis of the swing motor 251 in a direction away from the barrel 102 during loading of the projectile in the barrel 102. Further, the stub stopper 252 may be adapted to rotate with respect to the axis of the swing motor 251 in a direction towards the barrel 102 during firing of the projectile from the barrel 102.

The stub collector 253 may be disposed at the bottom of the turret 101 and adapted to collect stubs released from the barrel 102 of the turret 101. The stub stopper 252 may be able to swing, with respect to the axis of the swing motor 251 which facilitates the stub stopper 252 to move away from the barrel 102 of the turret 101 during loading operation of the projectile. The stub stopper 252 may be kept in a position along the central axis of the barrel 102 of the turret 101 after firing the projectile to stop the stub. The stub may be released from the turret 101 and hit the stub stopper 252 and subsequently, the stub may be collected in the stub collector 252 placed at a bottom of turret 101.

Figure 7:
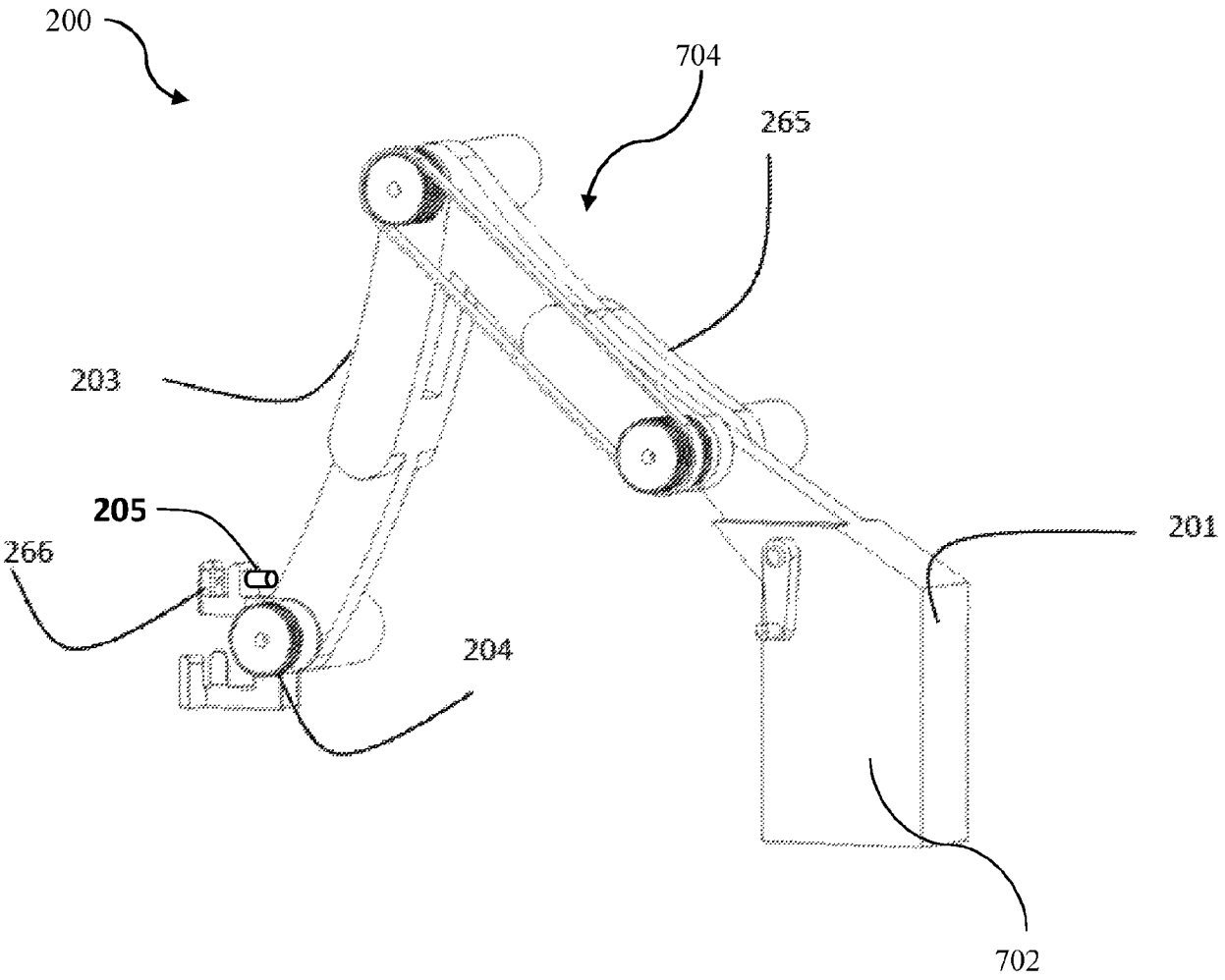

FIG. 7 illustrates a perspective view of the automated arm 200 of the automated projectile loader 110, according to an embodiment of the present disclosure. In an embodiment, the automated arm 200 may be disposed below the turret 101. The automated arm 200 may be adapted to load the plurality of projectiles from one of the carousal storage 502 and the bustle storage 226 in a barrel 102 of the turret 101.

The automated arm 200 may be adapted to clasp a projectile from one of the carousal storage 502 and the bustle storage 226 and adapted align the projectile with the barrel 102.

In an embodiment, the automated arm 200 includes a base member 702, a plurality of arms 704 coupled to the base member 702, and a plurality of revolute joints adapted to movably couple the plurality of arms 704 with each other. The plurality of arms 704 may be adapted to be moved with respect to each other in a planar motion between a retracted position and an extended position. In an embodiment, the plurality of arms includes a back arm 202 coupled to the base member 702, a fore arm 203 coupled to the back arm 202, and a wrist 204 coupled to the fore arm 203.

In an embodiment, the automated arm 200 may be mounted in a constraint location without interference for loading and unloading action. The automated arm 200 is in a planer configuration with three revolute joint and links. The combination of motions such as the back arm 202 and the fore arm 203 motions are able to reach the bustle and carousal bin locations as well as able to fold in compact manner when it is not in operation. The automated arm 200 may include a bin gripper 206 mounted on the fore arm 203 and adapted to hold one of the bustle bin 223 and the carousal twin bin 211 from the bustle storage 226 and the carousal storage 502, respectively. The bin gripper 206 may be provided with a solenoid interlocking mechanism adapted to hold one of the bustle bin 223 and the carousal twin bin 211.

In an embodiment, the automated arm 200 may include, but is not limited to, a solenoid pin 205 mounted at the bin gripper 206. The solenoid pin 205 may be adapted to lock one of the bustle bin 223 and the carousal twin bin 211 with the bin gripper 206. The solenoid pin 205 may be in communication with the controlling unit 104 and adapted to move in a locked position during loading of the projectile in the turret 101 and in an unlocked position when the automated arm 200 moves to the retracted position.

Figure 8:
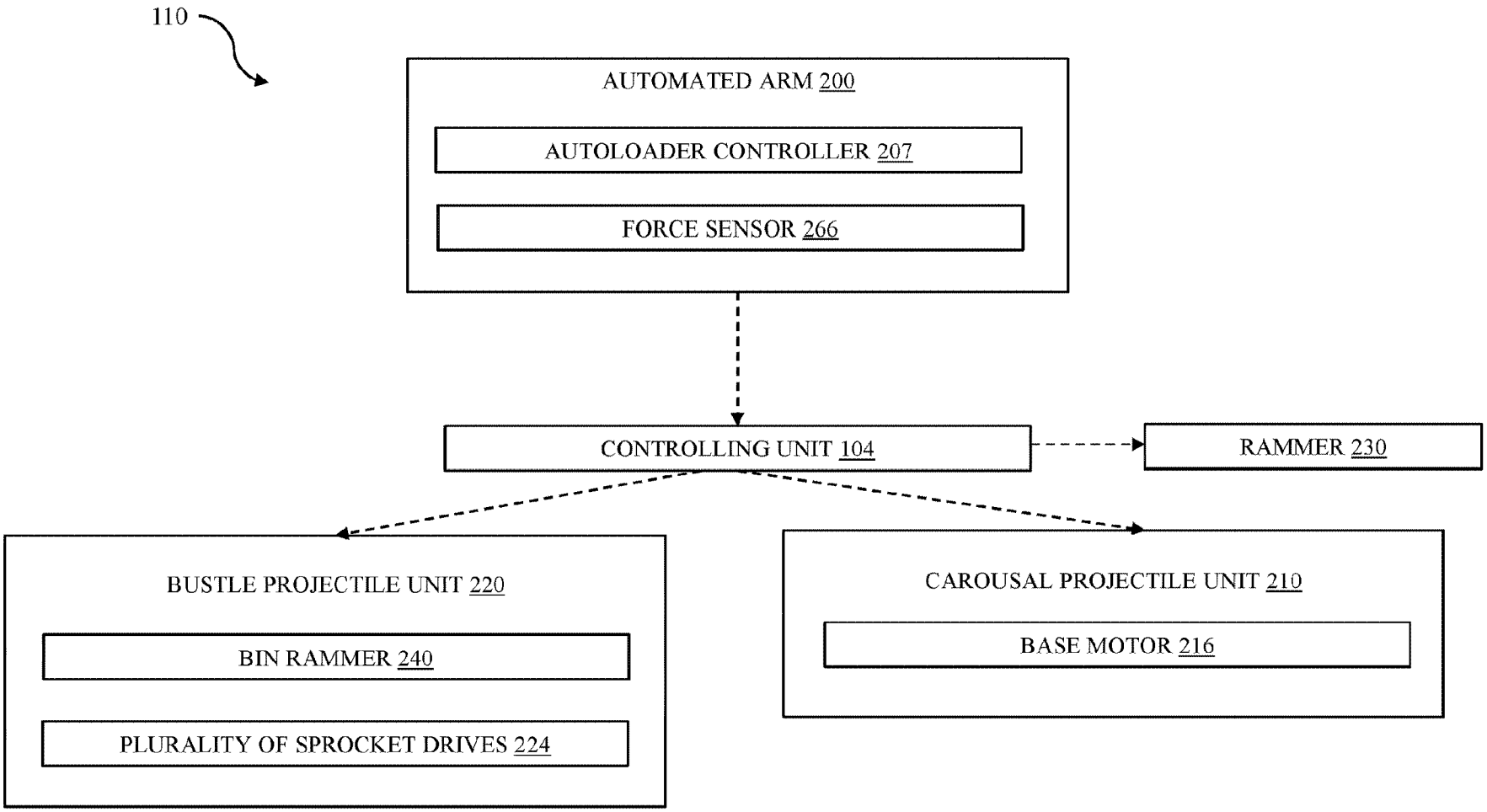
FIG. 8 illustrates a block diagram depicting the automated projectile loader, according to an embodiment of the present disclosure.

Further, the automated arm 200 may include a force sensor 266 attached to the bin gripper 206 and in communication with the controlling unit 104 (shown in FIG. 8). The controlling unit 104 is configured to receive an input indicative of a force applied on one of the bustle bin 223 and the carousal twin bin 211 by the bin gripper 206. Further, the controlling unit 104 is configured to compare the input with a threshold value of force to be applied by the bin gripper 206. The controlling unit 104 is configured to adjust the bin gripper 206 to hold one of the bustle bin 223 and the carousal twin bin 211, based on the comparison. Operational and constructional details of the controlling unit 104 are explained with respect to the subsequent sections of the present disclosure.

In an embodiment, the automated arm 200 may include an autoloader handle 261 attached to the base member. The autoloader handle 261 may be adapted to be manually operated to rotate the fore arm 203, the back arm 202, and the wrist 204. The automated arm 200 may include a belt drive 265 adapted to transfer movement of the autoloader handle 261 to the revolute joints between the fore arm 203, the back arm 202, and the wrist 204. In the illustrated embodiment, the automated arm 200 may include back arm sprockets 262, forearm sprockets 263, and wrist sprockets 264.

Figure 12A:
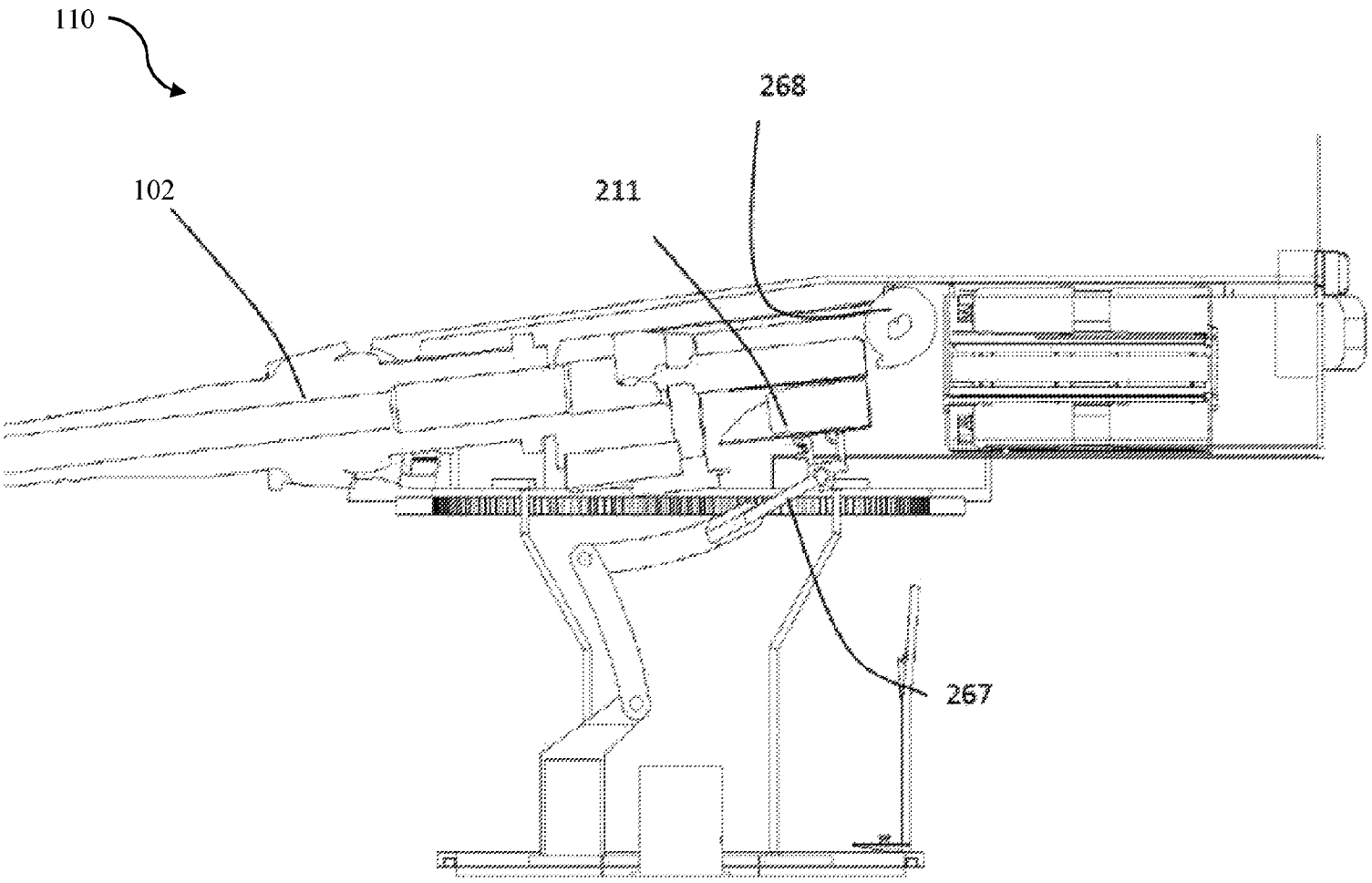
FIGS. 12*a*-12*b* illustrate an operation of the automated arm to align the projectile with a barrel of the turret of the vehicle, according to an embodiment of the present disclosure.
Figure 12B:
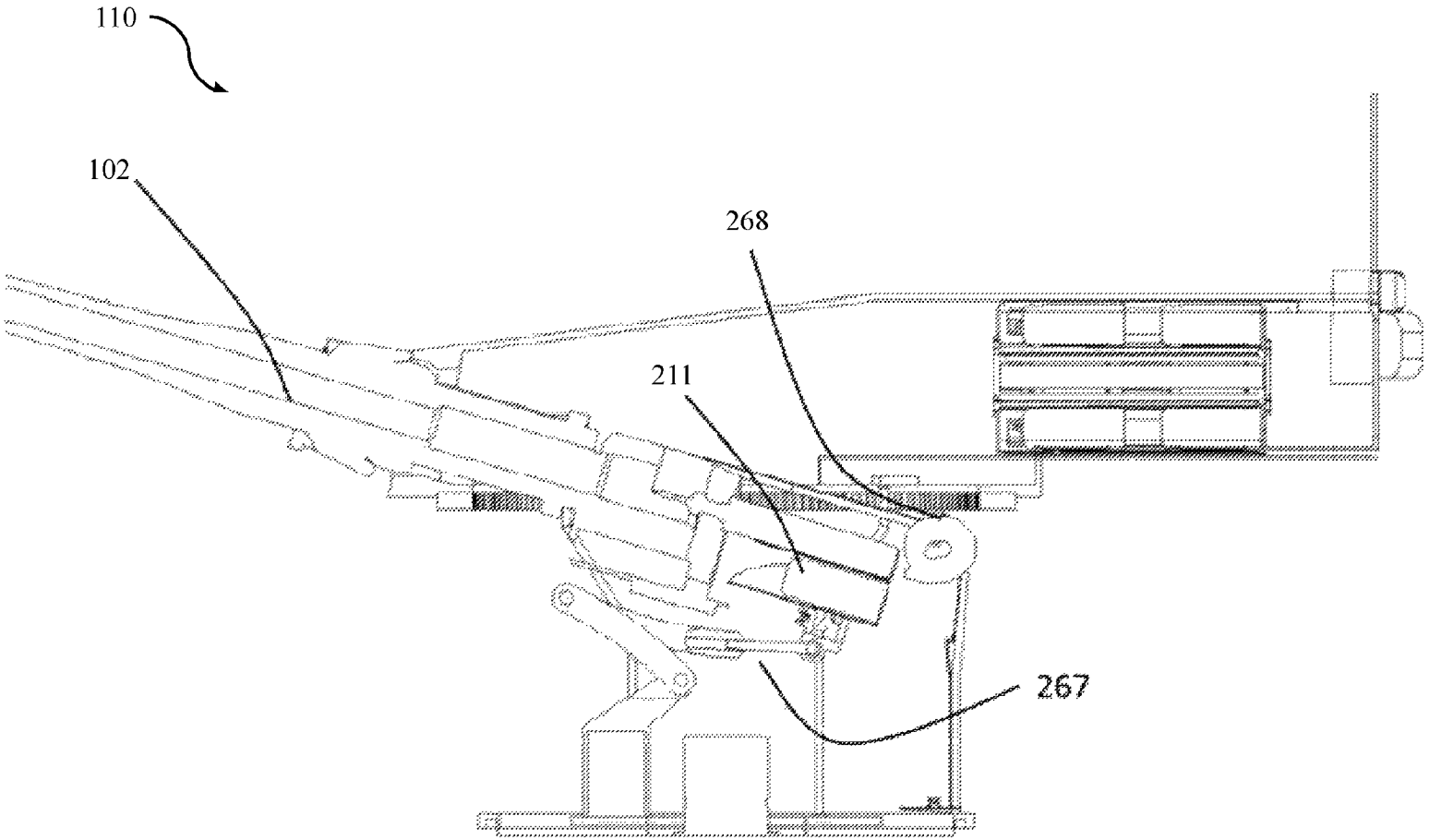

The movement of the autoloader handle 261 may be transferred to each of the back arm sprockets 262, the forearm sprockets 263, and the wrist sprockets 264 through the belt drive 265 to move the automated arm 200 between the extended position and the retracted position. Further, the automated arm 200 may include a prismatic linear actuator 267 coupled to the fore arm 203 and the wrist 204. The prismatic linear actuator 267 may be adapted to align the projectile along the central axis of the barrel 102 when the turret 101 is in one of an elevated position and a depressed position with respect to the bustle storage 226 as shown in FIGS. 12*a*-12*b*.

FIG. 8 illustrates a block diagram depicting the automated projectile loader 110, according to an embodiment of the present disclosure. In an embodiment, the controlling unit 104 may be embodied a central processing unit, without departing from the scope of the present disclosure. The automated projectile loader 110 may include the controlling unit 104 communicatively coupled with the bustle projectile unit 220, the carousal projectile unit 210, and the automated arm 200. In an embodiment, the controlling unit 104 may include a processor, memory, modules, and data. The modules and the memory are coupled to the processor. The processor can be a single processing unit or a number of units, all of which could include multiple computing units. The processor may be implemented as one or more microprocessors, microcomputers, microcontrollers, digital signal processors, central processing units, state machines, logic circuitries, and/or any devices that manipulate signals based on operational instructions. Among other capabilities, the processor is configured to fetch and execute computer-readable instructions and data stored in the memory.

The memory may include any non-transitory computer-readable medium known in the art including, for example, volatile memory, such as static random access memory (SRAM) and dynamic random access memory (DRAM), and/or non-volatile memory, such as read-only memory (ROM), erasable programmable ROM, flash memories, hard disks, optical disks, and magnetic tapes. The modules, amongst other things, include routines, programs, objects, components, data structures, etc., which perform particular tasks or implement data types. The modules may also be implemented as, signal processor(s), state machine(s), logic circuitries, and/or any other device or component that manipulate signals based on operational instructions.

Further, the modules can be implemented in hardware, instructions executed by a processing unit, or by a combination thereof. The processing unit can comprise a computer, a processor, such as the processor, a state machine, a logic array or any other suitable devices capable of processing instructions. The processing unit can be a general-purpose processor which executes instructions to cause the general-purpose processor to perform the required tasks or, the processing unit can be dedicated to perform the required functions. In another aspect of the present disclosure, the modules may be machine-readable instructions (software) which, when executed by a processor/processing unit, perform any of the described functionalities.

In an embodiment, the controlling unit 104 may be in communication with the automated arm 200. The controlling unit 104 may be configured to receive an input indicative of selection of a projectile from one of the carousal storage 502 and the bustle storage 226. Further, the controlling unit 104 may be configured to operate the automated arm 200 to load the projectile from one of the carousal storage 502 and the bustle storage 226 in the barrel 102 based on the received input. In an embodiment, the automated arm 200 may include an autoloader controller 207 (as shown in FIG. 1) in communication with the controlling unit 104. The controlling unit 104 may be configured to operate the autoloader controller 207 to actuate the automated arm 200 between the retracted position and the extended position.

Further, in an embodiment, the controlling unit 102 may be in communication with the base motor 216 of the carousal projectile unit 210. The controlling unit 102 may be configured to operate the base motor 216 to rotate the carousal base 218 of the carousal projectile unit 210. The controlling unit 102 may be in communication with the electric motor to drive the plurality of sprocket drives 224 of the bustle projectile unit 220. Further, the controlling unit 102 may be in communication with the electric motor of the rammer 230. The controlling unit 104 may be configured to operate the electric motor to swing the rammer 230 for loading the projectiles along with the propulsion in the barrel 102 of the turret 101. Furthermore, the controlling unit 104 may be in communication with the bin rammer 240 of the bustle projectile unit 220 to pull and push the bustle bin 223 towards the barrel 102. The controlling unit 104 may be configured to adjust the height of the bin rammer 240 and the rammer 230 of the automated projectile loader 110.

Figure 9A:
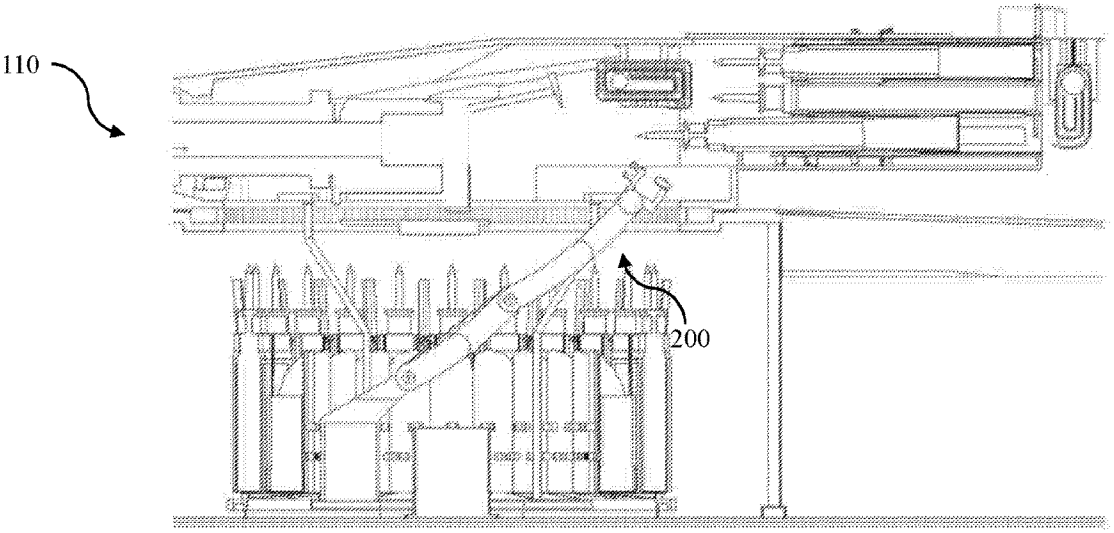
FIGS. 9*a*-9*f* illustrate an operation of the automated arm to load projectiles from the bustle storage of the bustle projectile unit, according to an embodiment of the present disclosure.

FIGS. 9*a*-9*f* illustrate an operation of the automated arm 200 to load projectiles from the bustle storage 226 of the bustle projectile unit, according to an embodiment of the present disclosure. Referring to FIG. 9*a*, the controlling unit 104 may receive the input indicative of selection of the projectile to be loaded from the bustle storage 226. The plurality of sprocket drives 224 may be driven to move one of the bustle bins 223 in the bustle storage 226 along the barrel 102 of the turret 101. Subsequently, the bin rammer 240 may be operated to push one of the bustle bins 223 from the bustle storage 226. Further, the automated arm 200 may be operated by the controlling unit 104 to the extended position to hold the bustle bin 223 pushed by the bin rammer 240.

Figure 9B:
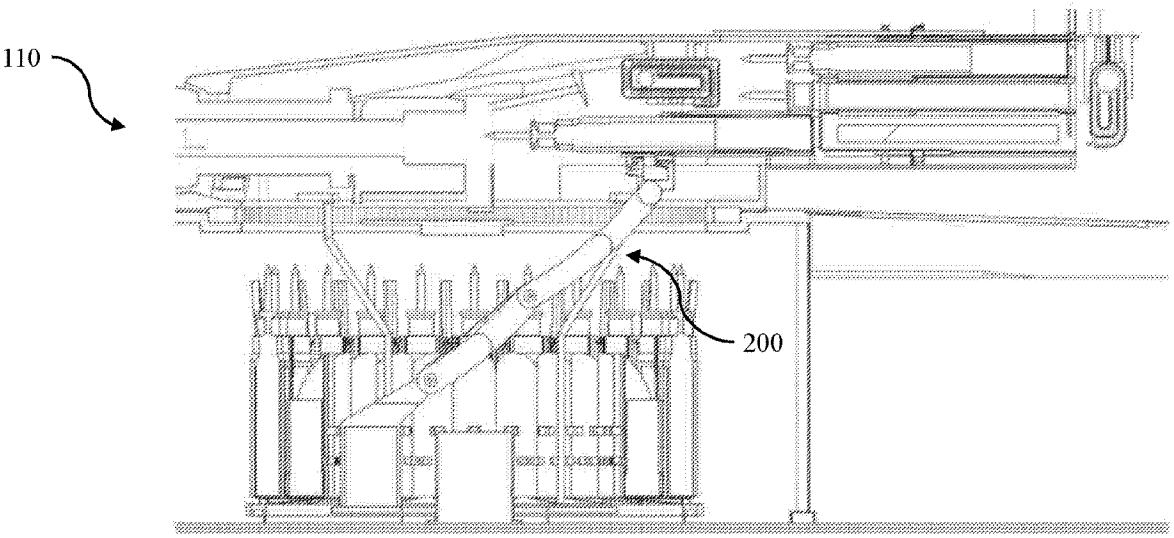
Figure 9C:
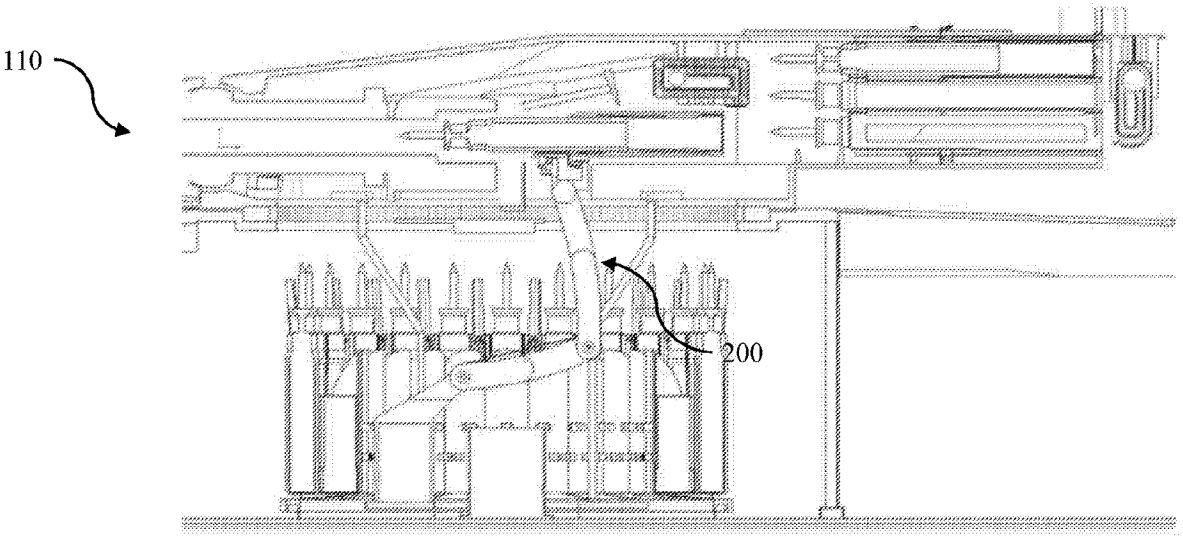
Figure 9D:
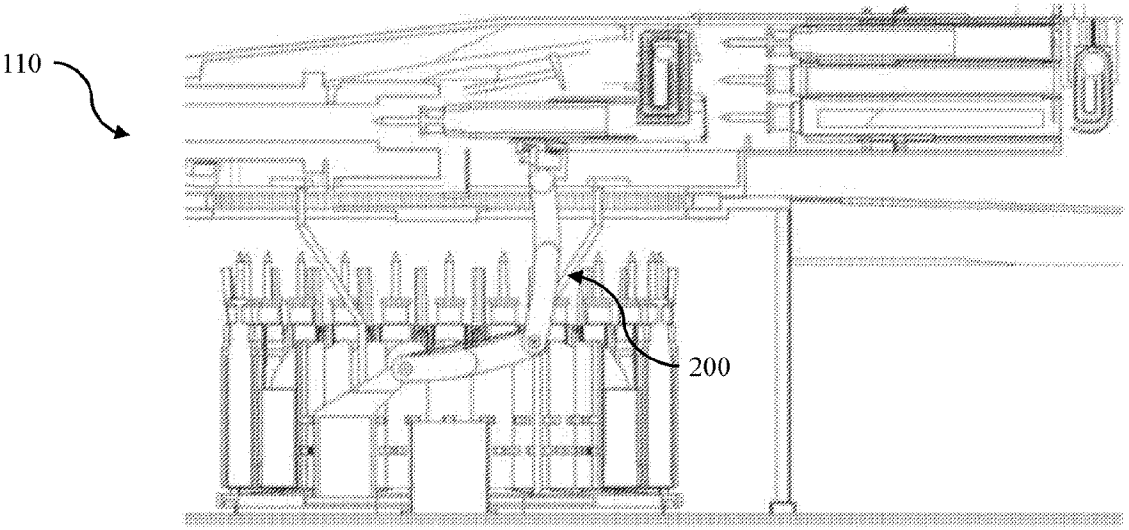

Referring to FIG. 9*b*, the automated arm 200 may engage with the holding members formed on the bustle bin 223 to hold the bustle bin 223 while loading the projectile along with the propellant. The automated arm 200 may align the bustle bin 223 along the central axis of the barrel 102 of the turret 101. Referring to FIG. 9*c*, the automated arm 200 may move the bustle bin 223 towards the barrel 102 of the turret 101 for loading of the projectile along with the propellant. Further, referring to FIG. 9*d*, the controlling unit 104 may operate the electric motor 231 to swing the rammer 230.

Figure 9E:
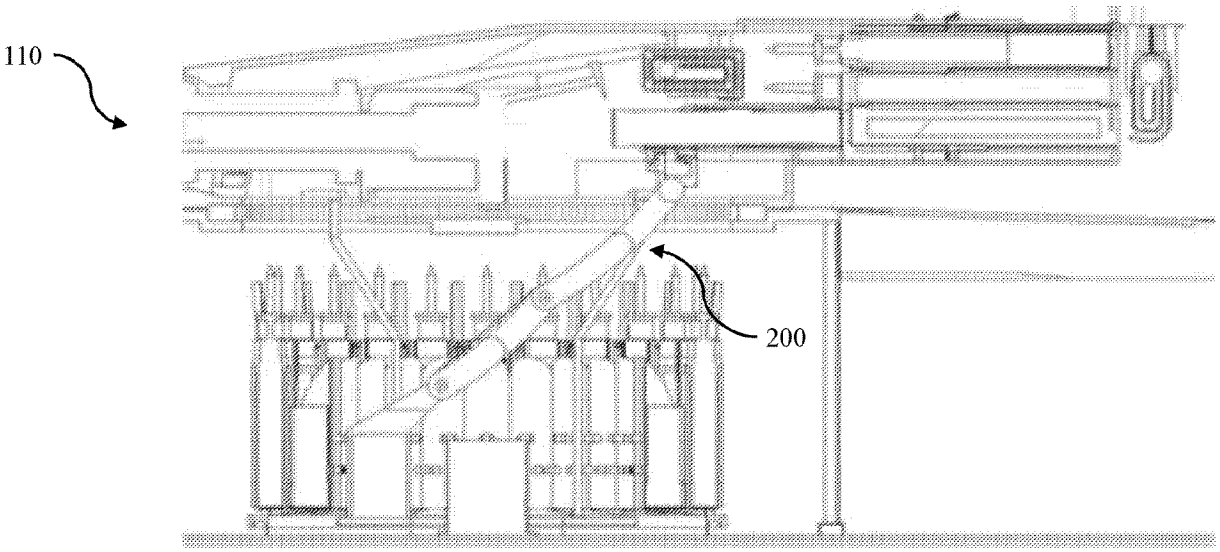
Figure 9F:
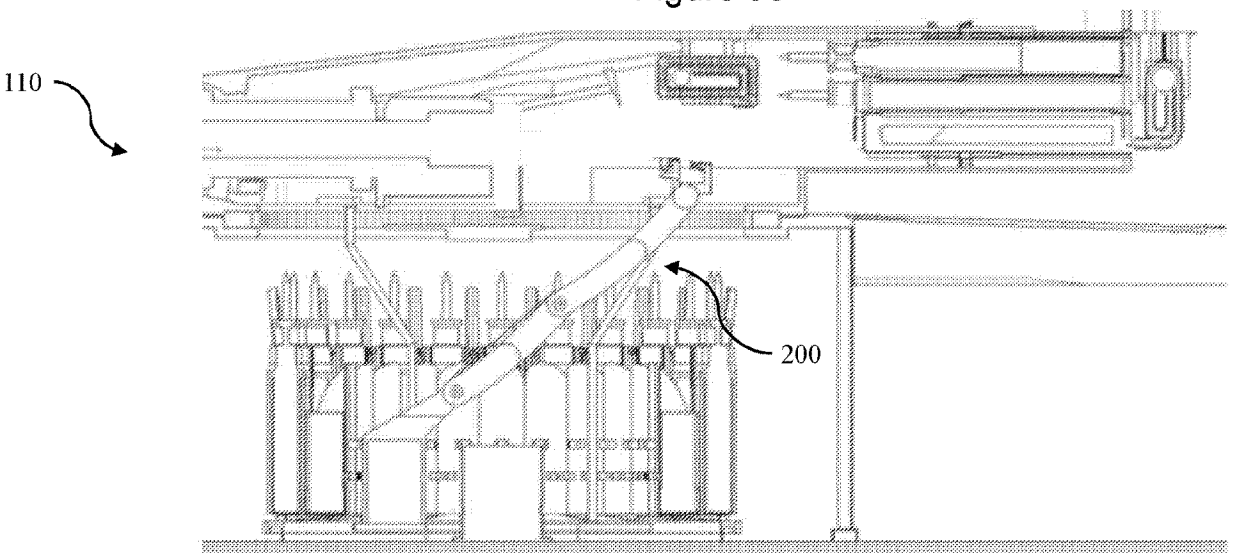

Subsequently, the rammer 230 may push the projectile and the propellant from the bustle bin 223 simultaneously within the barrel 102 of the turret 101. Referring to FIGS. 9*e* and 9*f*, upon loading of the projectile and the propellant in the barrel 102, the automated arm 200 may move the bustle bin 223 away from the barrel 102 and towards the bustle storage 226. Further, the bin rammer 240 may pull back the bustle bin 223 from the automated arm 200 in the bustle storage 226. Subsequently, the automated arm 200 may be moved to the retracted position before firing the projectile from the turret 101.

Figure 10A:
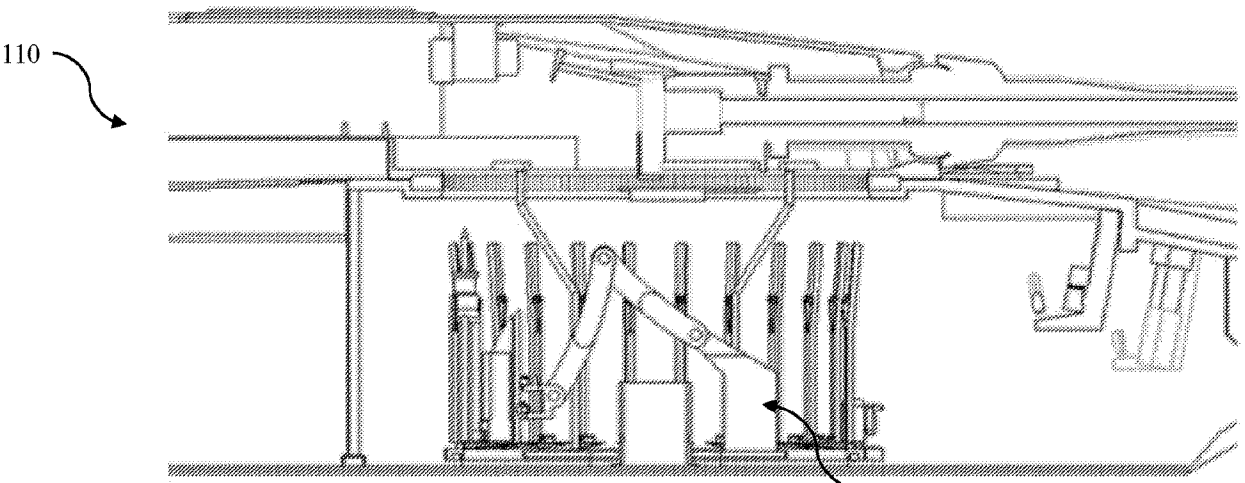
FIGS. 10*a*-10*e* illustrate an operation of the automated arm to load projectiles from the carousal storage of the carousal projectile unit, according to an embodiment of the present disclosure.
Figure 10B:
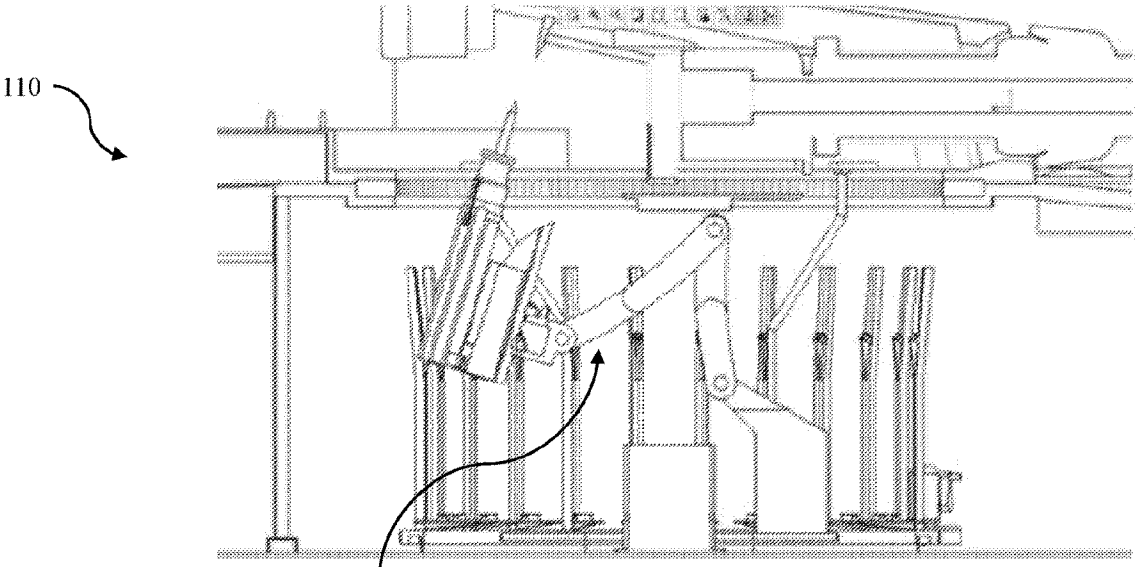

FIGS. 10*a*-10*e* illustrate an operation of the automated arm 200 to load projectiles from the carousal storage 502 of the carousal projectile unit, according to an embodiment of the present disclosure. Referring to FIGS. 10*a* and 10*b*, the controlling unit 104 may receive the input indicative of selection of the projectile to be loaded from the carousal storage 502. Subsequently, the automated arm 200 may be operated by the controlling unit 104 to hold the carousal twin bin 211 from the carousal base 218 of the carousal projectile unit. The solenoid pin 205 at the bin gripper 206 of the automated arm 200 may be adapted to lock the carousal twin bin 211 for loading of the projectile and the propulsion in the barrel 102.

Figure 10C:
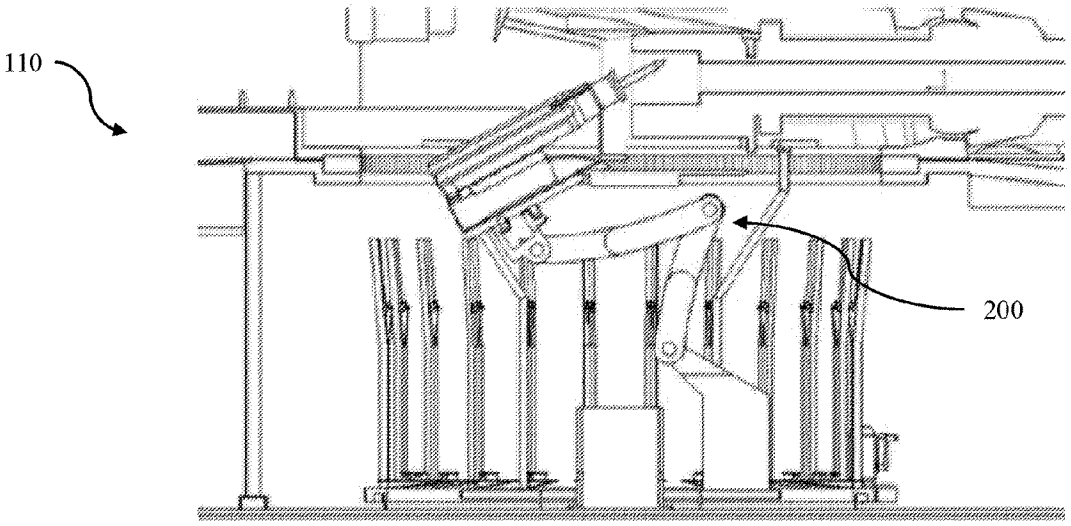
Figure 10D:
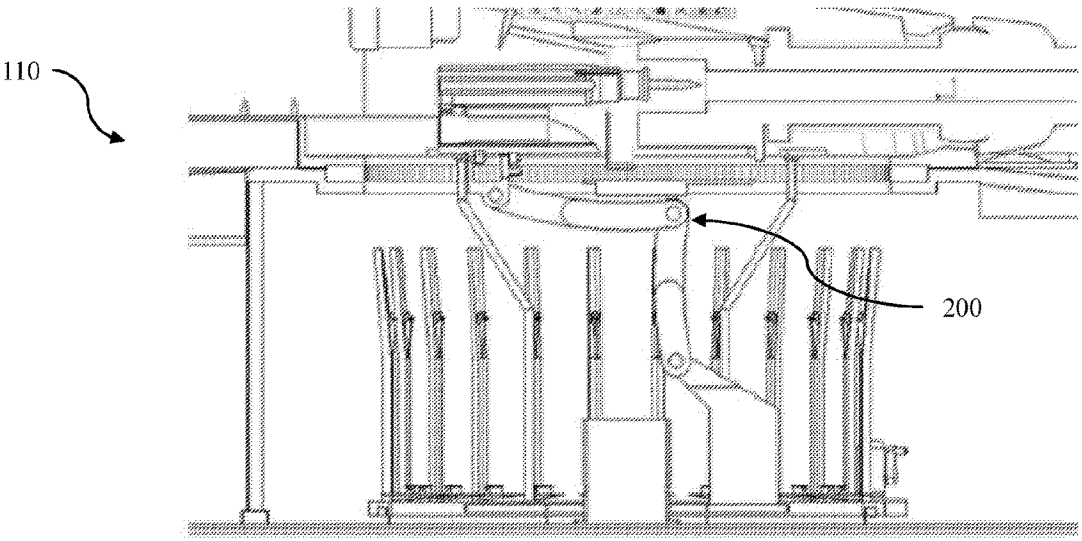
Figure 10E:
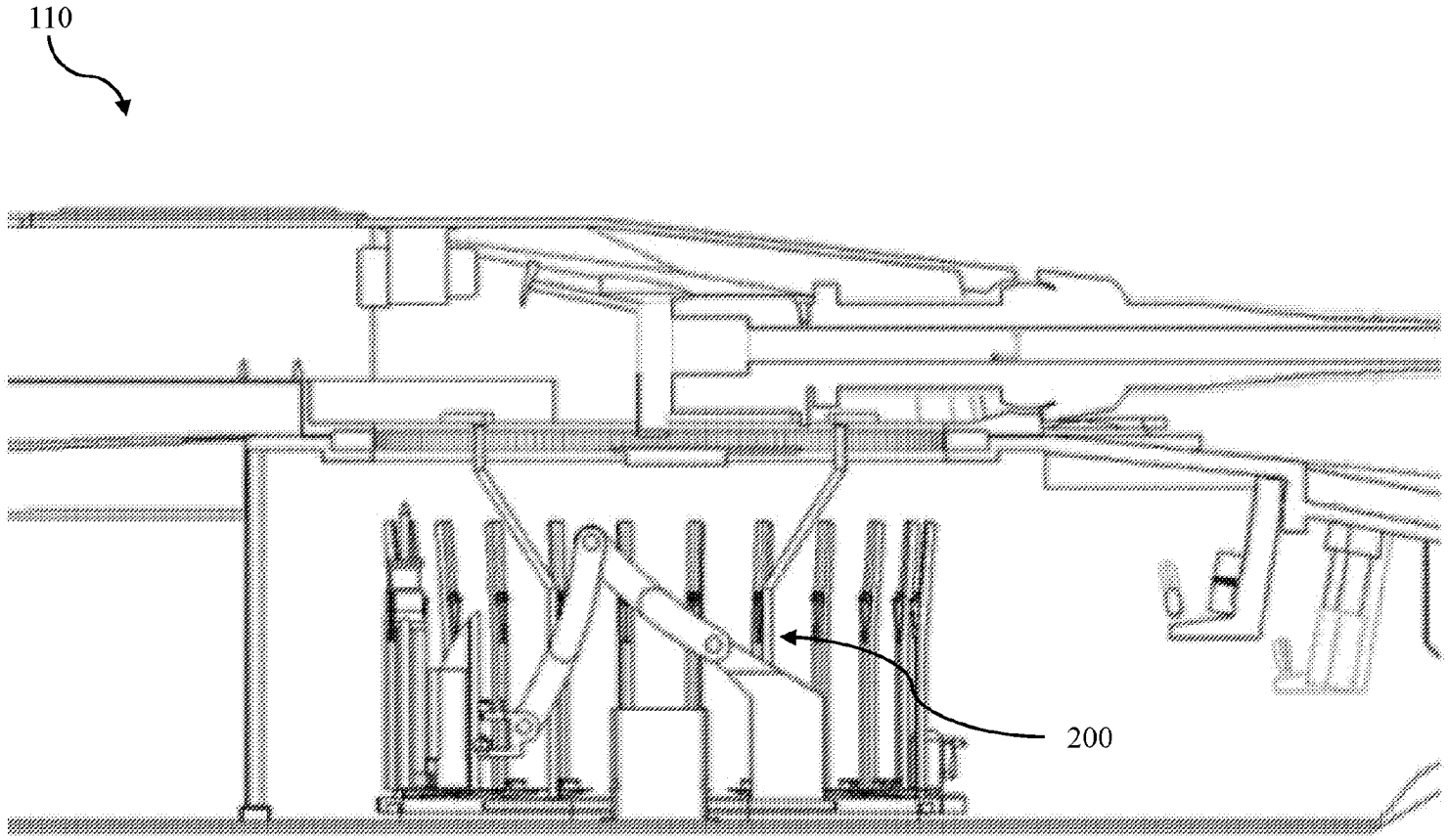

Referring to FIG. 10*b*, FIGS. 10*c*, and 10*d*, the automated arm 200 may engage with the holding members formed on the bin holder of the carousal twin bin 211 to hold the carousal twin bin 211 while loading the projectile along with the propellant. The automated arm 200 may align the carousal twin bin 211 along the central axis of the barrel 102 of the turret 101. Referring to FIGS. 10*d* and 10*e*, the automated arm 200 may move the carousal twin bin 211 towards the barrel 102 of the turret 101 for loading of the projectile along with the propellant. Further, the controlling unit 104 may operate the electric motor 231 to swing the rammer 230.

Subsequently, the rammer 230 may push the projectile from the first bin of the carousal twin bin 211. Further, the rammer 230 may be operated to push the propellent from the second bin of the carousal twin bin 211. Referring to FIG. 10*e*, upon loading of the projectile and the propellant in the barrel 102, the automated arm 200 may move the carousal twin bin 211 away from the barrel 102 and towards the carousal storage 502. Subsequently, the automated arm 200 may be moved to the retracted position before firing the projectile from the turret 101.

Figure 11A:
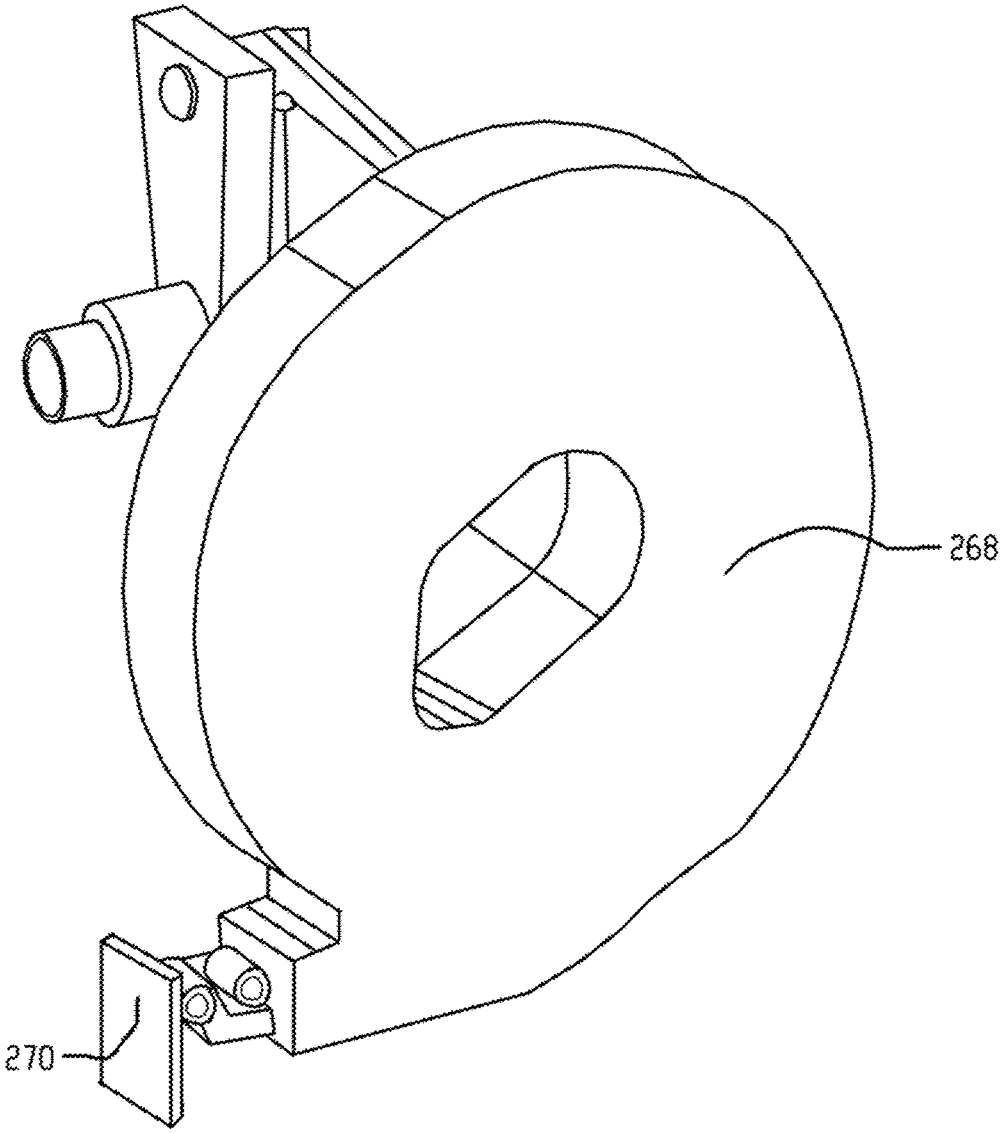
FIGS. 11*a*-11*c* illustrate perspective views of a rammer of the automated projectile loader, according to another embodiment of the present disclosure.
Figure 11B:
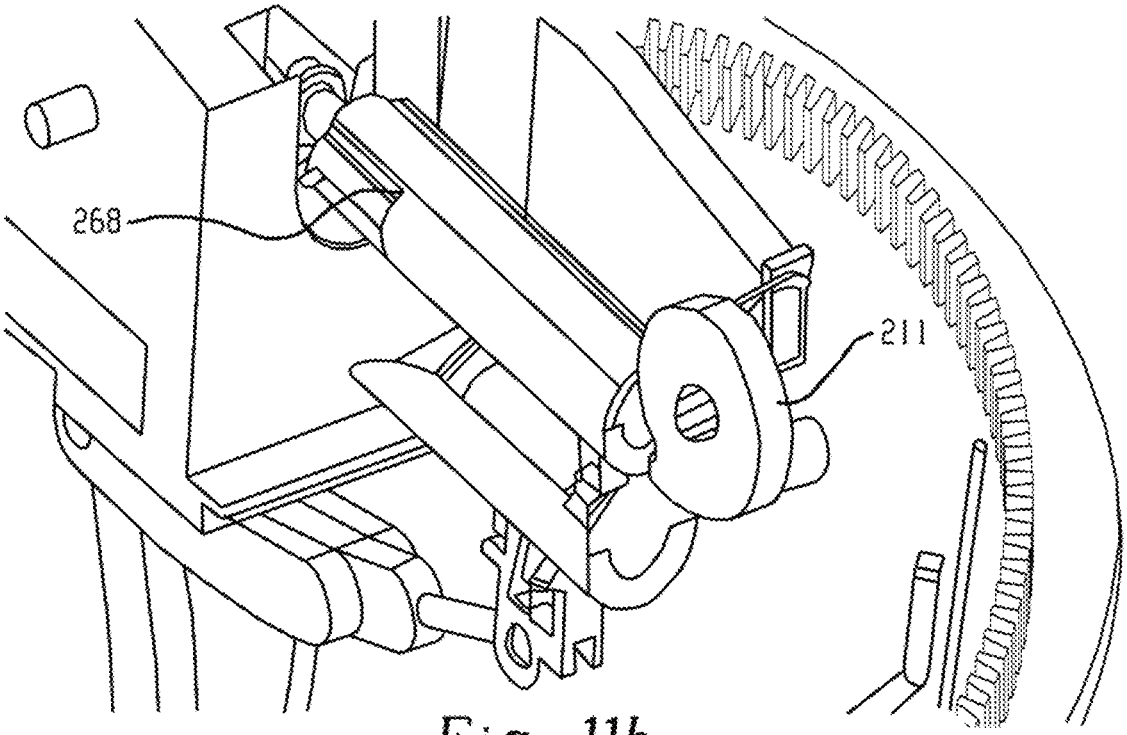
Figure 11C:
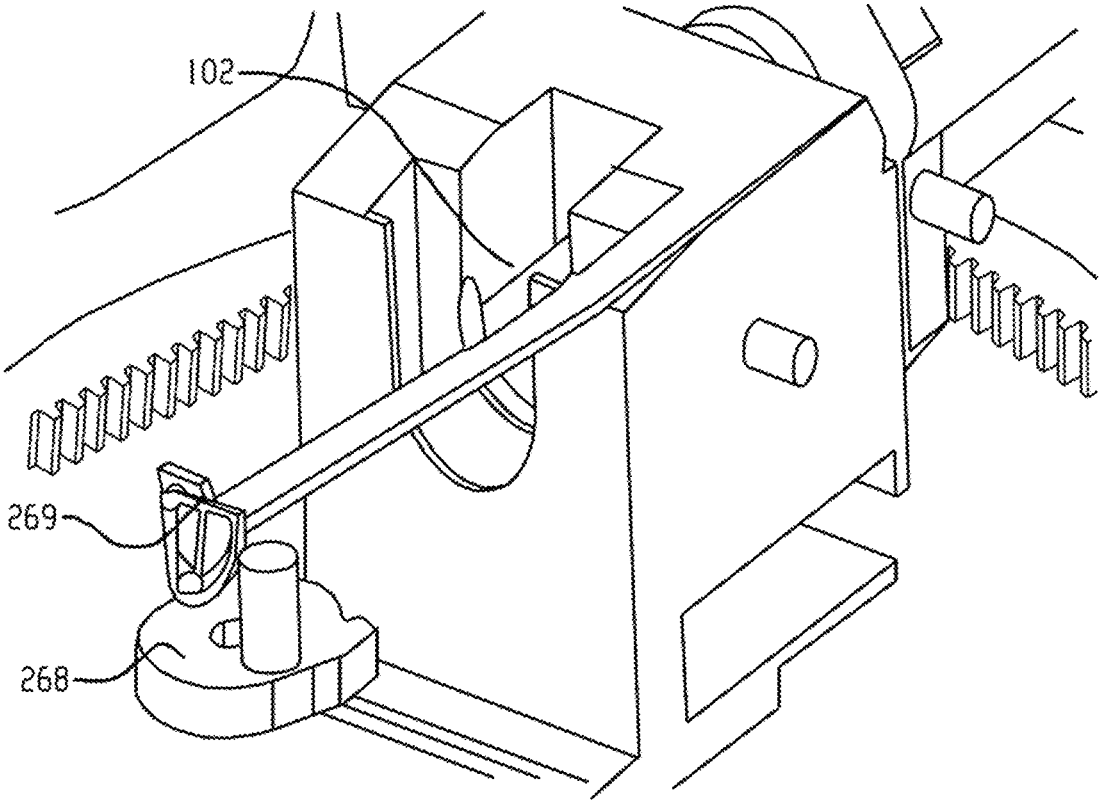

FIGS. 11*a*-11*c* illustrate perspective views of a rammer of the automated projectile loader 110, according to another embodiment of the present disclosure. The automated projectile loader 110 may be employed for loading projectiles and propellants within the barrel 102 aligned at different angles. Referring to FIG. 11*a*, FIG. 11*b*, and FIG. 11*c*, the automated projectile loader 110 may include a rammer 268 coupled to the rear end of the barrel 102. The rammer 268 may be adapted to be aligned with the central axis of the barrel 102. The rammer 268 may be adapted to slide the projectile within the barrel 102 from one of the bustle storage 226 and the carousal storage 502.

In an embodiment, the rammer may include an engaging finger 270 adapted to be operated to push the projectile and the propellant from one of the bustle bin 223 and the carousal twin bin 211 in the barrel 102. The engaging finger 270 may be operated between an extend position and a retracted position to push the projectile and the propellent in the barrel 102. Further, the automated projectile unit 110 may include a sector gear mechanism 269 disposed at the rear end of the barrel 102. The sector gear mechanism 269 may be operated to align the rammer with respect to the central axis of the barrel 102. In particular, the rammer 268 may be aligned to the central axis of the barrel 102 by indexing the rammer 268 using the sector gear mechanism 269. The sector gear mechanism 269 may be adapted to be engaged with the rammer 268. The sector gear mechanism 268 may be adapted to align the rammer 268 with the central axis of the barrel 102.

FIGS. 12*a*-12*b* illustrate an operation of the automated arm 200 to align the projectile with a barrel 102 of the turret 101 of the vehicle, according to an embodiment of the present disclosure. Referring to FIG. 12*a*, the turret 101 may be aligned in the depressed position with respect to the bustle storage 226. Referring to FIG. 12*b*, the turret 101 may be aligned in the elevated position with respect to the bustle storage 226. In the illustrated embodiments, referring to FIG. 12*a* and FIG. 12*b*, the prismatic linear actuator 267 coupled to the fore arm 203 and the wrist 204 of the automated arm 200 may align the projectile along the central axis of the barrel 102. The prismatic linear actuator 267 may be provided to manipulate the projectile orientation in such a way to align the projectile with the central axis of the barrel 102. Therefore, it facilitates to load the projectile in the barrel 102 aligned in depression (downward) position or in the elevated (upward) position.

Firstly, the automated arm 200 may be operated to hold and move one of the bustle bins 223 and the carousal twin bins 211 from the bustle storage 226 and the carousal storage 502, respectively. Subsequently, the prismatic linear actuator 267 may be operated to align one of the bustle bin 223 and the carousal twin bin 211 along the central axis of the barrel 102. Further, the rammer 268 may be operated by the controlling unit 104 to push the projectile and the propellant within the barrel 102. The rammer 268 may be attached with the turret 101 and the rammer is normally away kept at top of the turret 101 as shown in FIG. 12*b*.

Figure 13:
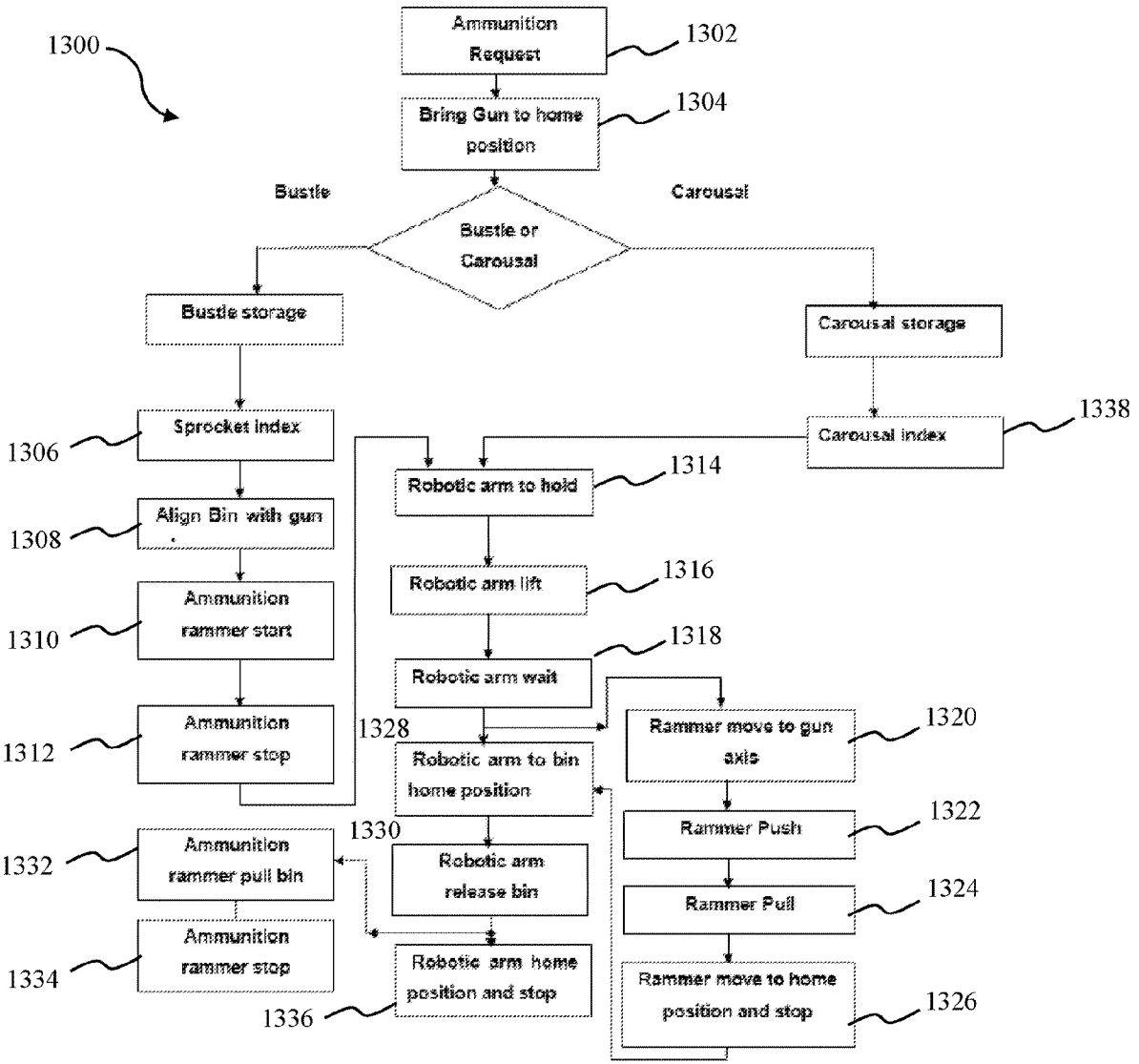
FIG. 13 illustrates a flowchart depicting a method of loading projectiles from the carousal storage and the bustle storage, according to an embodiment of the present disclosure.

FIG. 13 illustrates a flowchart depicting a method 1300 of loading projectiles from the carousal storage 502 and the bustle storage 226, according to an embodiment of the present disclosure. In an embodiment, the method 1300 of loading projectiles in a turret of a vehicle. The method 1300 may include receiving an input indicative of selection of a projectile from one of the bustle storage and the carousal storage to be loaded in the barrel 102 of the turret 101. Further, the method 1300 may include operating the automated arm 200 and one of the bustle projectile unit and the carousal projectile unit based on the received input.

If the received input is indicative of selection of the projectile from the bustle storage, then the method 1300 includes driving the plurality of sprocket drives of the bustle projectile unit to align the bustle bin with the barrel 102 of the turret 101. Further, the method 1300 includes actuating the bin rammer of the bustle projectile unit to push the bustle bin towards the barrel 102 of the turret 101. The method 1300 includes operating the automated arm 200 to hold the bustle bin and align the bustle bin with the central axis of the barrel 102. The solenoid pin mounted at the bin gripper of the automated arm 200 is actuated to lock the bustle bin with the bin gripper. Further, the method 1300 includes actuating the rammer positioned at the rear end of the barrel 102 to load the projectile and propellant from the bustle bin in the barrel 102 of the turret 101. The method 1300 includes actuating the bin rammer 240 to pull the bustle bin towards the bustle storage of the bustle projectile unit.

If the received input is indicative of selection of the projectile from the carousal storage, then the method 1300 includes moving the carousal base of a carousal projectile unit to align the carousal twin bin 211 to be aligned with the barrel of the turret. Further, the method 1300 includes operating the automated arm 200 to hold the carousal twin bin 211 and align the carousal twin bin with the central axis of the barrel. The solenoid pin mounted at the bin gripper is actuated to lock the carousal twin bin 211 with the bin gripper. Further, the method 1300 includes actuating the rammer to load the projectile and propellant from the carousal twin bin 211 in the barrel. The rammer is adapted to slide the projectile from the first bin of the carousal twin bin 211 and subsequently slide the propellant from the second bin of the carousal twin bin 211.

At block 1302, the controlling unit 104 may receive the input indicative of a request to load the projectile from one of the bustle storage 226 and the carousal storage 502. At block 1304, the controlling unit 104 may move the automated arm 200 to a home position, i.e., the retracted position. Further, based on the input received by the controlling unit 104, the automated projectile loader 110 may be operated to load the projectile from one of the bustle storage 226 and the carousal storage 502.

At block 1306, if the input is indicative of the request to load the projectile from the bustle storage 226, the controlling unit 104 may operate the plurality of sprocket drives 224 to index the bustle bin 223 to be loaded in the barrel 102. Further, at block 1308, the bustle bin 223 may be aligned with the barrel 102 of the turret 101. At block 1310 and 1312, the bin rammer 240 may be operated by controlling unit 104 to push the bustle bin 223 from the bustle storage 226 towards the barrel 102 of the turret 101. At block 1314, the automated arm 200 may be operated by the controlling unit to hold the bustle bin 223 pushed by the bin rammer 240. At block 1316 and block 1318, the automated arm 200 may be operated to move the bustle bin 223 towards the barrel 102 and subsequently, align the bustle bin 223 with the central axis of the barrel 102.

Further, at block 1320, the rammer 230 may be moved to the central axis of the barrel 102 of the turret 101. At block 1322, the rammer 230 may be rotated to push the projectile and the propellant from the bustle bin 223 within the barrel 102 of the turret 101. At block 1324 and block 1326, the rammer 230 may be retracted to a home position, upon loading the projectile and the propellant within the barrel 102. At block 1328, the automated arm 200 may be moved by the controlling unit 104 to the bustle storage 226. At block 1330, the automated arm 200 may release the bustle bin 223 in the bustle storage 226 of the bustle projectile unit. At block 1332, the bin rammer 240 may be operated to pull the bustle bin 223 which is released by the automated arm 200 in the bustle storage 226. At block 1334, an operation of the bin rammer 240 of the bustle projectile unit may be stopped. Further, at block 1336, the automated arm 200 may be moved to the home position, i.e., the retracted position by the controlling unit 104.

At block 1338, if the input is indicative of the request to load the projectile from the carousal storage 502, the controlling unit may operate the base motor to rotate the carousal base to index the carousal twin bin 211 stored in the carousal storage 502. At block 1314, the automated arm 200 may be operated by the controlling unit to hold the carousal twin bin 211 in the carousal storage 502. Further, at block 1316 and block 1318, the automated arm 200 may be operated to move the carousal twin bin 211 towards the barrel 102 and subsequently, align the carousal twin bin 211 with the central axis of the barrel 102.

Further, at block 1320, the rammer 230 may be moved to the central axis of the barrel 102 of the turret 101. At block 1322, the rammer 230 may be rotated to push the projectile and the propellant from the carousal twin bin 211 within the barrel 102 of the turret 101. At block 1324 and block 1326, the rammer 230 may be retracted to a home position, upon loading the projectile and the propellant within the barrel 102. At block 1328, the automated arm 200 may be moved by the controlling unit 104 to the carousal storage 502. At block 1330, the automated arm 200 may release the carousal twin bin 211 in the carousal storage 502 of the carousal projectile unit. Further, at block 1336, the automated arm 200 may be moved to the home position, i.e., the retracted position by the controlling unit 104.

As would be gathered, the present disclosure offers the automated projectile loader 110 and the method of loading projectiles for the vehicle. The automated projectile loader 110 may be employed for loading the projectiles from both the bustle storage 226 and the carousal storage 502. Therefore, requirement of separate loading systems for the bustle storage 226 and the carousal storage 502 is substantially eliminated by the automated projectile loader 110. The automated projectile loader 110 may be employed for loading two-piece projectiles in the barrel 102 of the turret 101 of the vehicle. Owing to loading of the projectiles from the bustle storage 226 and the carousal storage 502, high penetration requirement for the projectiles can be achieved with ease.

Further, the automated arm 200 of the automated projectile loader 110 may be provided with the autoloader handle 261 to manual overriding operation of the automated arm 200 during emergency scenarios. Further, a loader in the vehicle is removed and hence, there is no risk involved in injury or loss of life. Furthermore, a total number of projectiles handled in the vehicle may be substantially increased because of the projectiles from the bustle storage 226 and the carousal storage 502 are handled by single device, i.e., automated projectile loader 110. This substantially reduces additional components from the vehicle and results in reduction of overall weight of the vehicle. Further, the automated arm 200 of the automated projectile loader 110 is compact and can be folded between the extended position and the retracted position. The substantially reduces overall weight and space requirement of the automated projectile loader 110. Further, the automated projectile loader 110 can be operated to load the projectiles from the bustle storage 226 and the carousal storage 502 in the barrel 102 of the turret 101 aligned at different angles. Therefore, the automated projectile loader 110 and the method of the present disclosure is modular, efficient, light-weight, flexible in implementation, cost-effective, and convenient.

While specific language has been used to describe the present subject matter, any limitations arising on account thereto, are not intended. As would be apparent to a person in the art, various working modifications may be made to the method in order to implement the inventive concept as taught herein. The drawings and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment.

The invention claimed is:

1. An automated projectile loader (110) for a vehicle, the automated projectile loader (110) comprising:

a carousal projectile unit (210) mounted on a hull of the vehicle, wherein the carousal projectile unit (210) comprises a carousal storage adapted to store a plurality of projectiles oriented in a vertical direction;

a bustle projectile unit (220) disposed at a rear end of a turret of the vehicle, the bustle projectile unit (220) comprising a bustle storage adapted to store a plurality of projectiles and propellants oriented in a horizontal direction;

an automated arm (200) disposed below the turret and adapted to load the plurality of projectiles from one of the carousal storage and the bustle storage in a barrel of the turret, wherein the automated arm (200) is adapted to clasp a projectile from one of the carousal storage and the bustle storage and adapted align the projectile with the barrel;

a controlling unit (104) in communication with the automated arm (200) and configured to:

receive an input indicative of selection of a projectile from one of the carousal storage and the bustle storage; and operate the automated arm (200) to load the projectile from one of the carousal storage and the bustle storage in the barrel based on the received input.

2. The automated projectile loader (110) as claimed in claim 1, wherein the carousal projectile unit (210) comprising:

a carousal base (218) rotatably disposed on the hull of the vehicle, wherein the carousal base (218) is adapted to be mounted with the carousal storage;

a plurality of carousal twin bins (211) adapted to accommodate the plurality of projectiles and propellants, wherein each of the plurality of carousal twin bins (211) comprising:

a first bin adapted to accommodate a projectile from among the plurality of projectiles; and a second bin disposed adjacent to the first bin adapted to accommodate a propellant;

a bin holder disposed on the carousal base and adapted to hold the plurality of carousal twin bins;

a base motor (216) coupled to the carousal base (218) and adapted to rotate the carousal base (218), wherein the base motor (216) rotates the carousal base (218) to a rotation angle based on a position of the turret with respect to a central axis of the carousal base (218) and a number of carousal twin bins disposed on the carousal base; and a handle (217) engaged with the carousal base and adapted to be manually operated to rotate the carousal base.

3. The automated projectile loader (110) as claimed in claim 1, wherein the bustle projectile unit comprising:

a plurality of bustle bins (223) adapted to accommodate the plurality of projectiles and projectile, wherein the plurality of bustle bins is adapted to be connected to each other to form a chain of bustle bins;

a plurality of sprocket drives (224) adapted to be engaged with the plurality of bustle bins and adapted to drive the chain of bustle bins, wherein each of the plurality of sprocket drives (224) is adapted to driven by an electric motor for indexing the projectiles in the bustle storage; and a bin rammer (240) mounted on a rear side of the bustle storage and adapted to move a bustle bin from among the plurality of bustle bins in a direction towards or away with respect to the barrel.

4. The automated projectile loader (110) as claimed in claim 3, wherein the bin rammer (240) is adapted to pull and push the bustle bin towards the barrel, the bin rammer comprising:

a lead screw (233) adapted to adjust a height of the bin rammer (240) with respect to the plurality of bustle bins disposed in the bustle storage; and an engagement pin (241) adapted to be engaged with a protrusion formed on each of the plurality of bustle bins to move the plurality of bustle bins with respect to the barrel of the turret.

5. The automated projectile loader (110) as claimed in claim 4 further comprising a rammer (230) disposed at a rear end of the barrel of the turret and adapted to slide the projectile along with the propellant within the barrel from one of the bustle bin and the carousal twin bin, when the automated arm (200) aligns one of the bustle bin and the carousal twin bin with a central axis of the barrel, wherein the rammer (230) is adapted to:

slide the projectile and the propellant from the bustle bin at a same time; and slide the projectile from the first bin of the carousal twin bin and subsequently slide the propellant from the second bin of the carousal twin bin.

6. The automated projectile loader (110) as claimed in claim 3 further comprising a rammer (230) disposed at a rear end of the barrel of the turret and adapted to slide the projectile along with the propellant within the barrel from one of the bustle bin and the carousal twin bin, when the automated arm (200) aligns one of the bustle bin and the carousal twin bin with a central axis of the barrel, wherein the rammer (230) is adapted to:

slide the projectile and the propellant from the bustle bin at a same time; and slide the projectile from the first bin of the carousal twin bin and subsequently slide the propellant from the second bin of the carousal twin bin.

7. The automated projectile loader (110) as claimed in claim 1 further comprising an Ejector assembly comprising:

a swing motor (251);

a stub stopper (252) mounted on a rear end of the barrel of the turret and rotatably coupled to the swing motor (251), wherein the stub stopper (252) is adapted to rotate with respect to an axis:

in a direction away from the barrel during loading of the projectile in the barrel; and in a direction towards the barrel during firing of the projectile from the barrel; and a stub collector (253) disposed at a bottom of the turret and adapted to collect stubs released from the barrel of the turret.

8. The automated projectile loader (110) as claimed in claim 1, wherein the automated arm (200) includes a base member (702), a plurality of arms coupled to the base member (702), and a plurality of revolute joints adapted to movably couple the plurality of arms with each other, wherein the plurality of arms is adapted to be moved with respect to each other in a planar motion between a retracted position and an extended position.

9. The automated projectile loader (110) as claimed in claim 8, wherein the plurality of arms includes a back arm (202) coupled to the base member (702), a fore arm (203) coupled to the back arm (202), a wrist (204) coupled to the fore arm (203).

10. The automated projectile loader (110) as claimed in claim 9, further comprising:

an autoloader handle (261) attached to the base member (702) and adapted to be manually operated to rotate the fore arm (203), the back arm (202), and the wrist (204); and a belt drive (265) adapted to transfer movement of the autoloader handle (261) to the revolute joints between the fore arm (203), the back arm (202) and the wrist (204).

11. The automated projectile loader (110) as claimed in claim 9, wherein the automated arm (200) includes a prismatic linear actuator (267) coupled to the fore arm (203) and the wrist (204), the prismatic linear actuator (267) is adapted to align the projectile along a central axis of the barrel when the turret is in one of an elevated position and a depressed position with respect to the bustle storage.

12. The automated projectile loader (110) as claimed in claim 11 further comprising:

a rammer (230) coupled to a rear end of the barrel and adapted to be aligned with a central axis of the barrel, wherein the rammer (2330) is adapted to slide the projectile within the barrel from one of the bustle storage and the carousal storage; and a sector gear mechanism (269) disposed at the rear end of the barrel and adapted to be engaged with the rammer (230), wherein the sector gear mechanism (269) is adapted to align the rammer (230) with the central axis of the barrel.

13. The automated projectile loader (110) as claimed in claim 9, wherein the automated arm (200) includes a bin gripper (206) mounted on the fore arm and adapted to hold one of a bustle bin and a carousal twin bin from the bustle storage and the carousal storage, respectively.

14. The automated projectile loader (110) as claimed in claim 13 further comprising:

a solenoid pin (205) mounted at the bin gripper (206) and adapted to lock one of the bustle bin and the carousal twin bin with the bin gripper (206), wherein the solenoid pin (205) is in communication with the controlling unit (104) and adapted to move in a locked position during loading of the projectile in the turret and in an unlocked position when the automated arm (200) moves to a retracted position.

15. The automated projectile loader (110) as claimed in claim 13 further comprising a force sensor (266) attached to the bin gripper (206) and in communication with the controlling unit (104), wherein the controlling unit is configured to:

receive an input indicative of a force applied on one of the bustle bin and the carousal twin bin by the bin gripper (206);

compare the input with a threshold value of force to be applied by the bin gripper (206); and adjust the bin gripper (206) to hold one of the bustle bin and the carousal twin bin (211), based on the comparison.

16. A method (1300) of loading projectiles in a turret of a vehicle, the method (1300) comprising:

receiving an input indicative of selection of a projectile from one of a bustle storage and a carousal storage to be loaded in a barrel of the turret; and operating an automated arm (200) and one of a bustle projectile unit (220) and a carousal projectile unit (210) based on the received input, wherein if the received input is indicative of selection of the projectile from the bustle storage, the method comprising:

driving a plurality of sprocket drives (224) of the bustle projectile unit (220) to align a bustle bin with the barrel of the turret;

actuating a bin rammer (240) of the bustle projectile unit (220) to push the bustle bin towards the barrel of the turret;

operating the automated arm (200) to hold the bustle bin and align the bustle bin with a central axis of the barrel, wherein a solenoid pin mounted at a bin gripper of the automated arm is actuated to lock the bustle bin with the bin gripper;

actuating a rammer (230) positioned at a rear end of the barrel to load the projectile and propellant from the bustle bin in the barrel of the turret; and actuating the bin rammer (240) to pull the bustle bin towards the bustle storage of the bustle projectile unit (220); and wherein if the received input is indicative of selection of the projectile from the carousal storage, the method comprising:

moving a carousal base (218) of the carousal projectile unit (210) to align a carousal twin bin (211) to be aligned with the barrel of the turret;

operating the automated arm (200) to hold the carousal twin bin (211) and align the carousal twin bin (211)

with the central axis of the barrel, wherein the solenoid pin mounted at the bin gripper is actuated to lock the carousal twin bin (211) with the bin gripper; and actuating the rammer (230) to load the projectile and propellant from the carousal twin bin in the barrel, wherein the rammer (230) is adapted to slide the projectile from a first bin of the carousal twin bin (211) and subsequently slide the propellant from a second bin of the carousal twin bin (211).

* * * * *